US012741357B2

(12) United States Patent
Hsiao et al.

(10) Patent No.: US 12,741,357 B2
(45) Date of Patent: Sep. 22, 2026

(54) MULTI-PATTERN IN-PAD SURFACE FOR POLISH RATE CONTROL

(71) Applicant: Taiwan Semiconductor Manufacturing Company, Ltd., Hsinchu (TW)

(72) Inventors: Hau-Yi Hsiao, Chiayi City (TW); Kuo-Ming Wu, Zhubei City (TW); Sheng-Chau Chen, Tainan City (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 507 days.

(21) Appl. No.: 18/187,464

(22) Filed: Mar. 21, 2023

(65) Prior Publication Data

US 2024/0316724 A1 Sep. 26, 2024

(51) Int. Cl.

| | |
|---|---|
| ***B24B 51/00*** | (2006.01) |
| ***B24B 7/22*** | (2006.01) |
| ***B24D 7/18*** | (2006.01) |

(52) U.S. Cl.

CPC ..... *B24B 51/00* (2013.01); *B24B 7/228* (2013.01); *B24D 7/18* (2013.01)

(58) Field of Classification Search

CPC ..... B24B 37/11; B24B 37/20; B24B 37/22; B24B 37/24; B24B 37/26

See application file for complete search history.

(56) References Cited

U.S. PATENT DOCUMENTS

| | | | | |
|---|---|---|---|---|
| 5,020,283 | A * | 6/1991 | Tuttle | B24B 13/01 451/550 |
| 6,062,958 | A * | 5/2000 | Wright | B24B 37/11 451/41 |
| 6,186,870 | B1 * | 2/2001 | Wright | B24B 37/11 451/63 |
| 6,964,598 | B1 * | 11/2005 | Leong | H01L 21/3212 451/529 |
| 7,004,823 | B2 * | 2/2006 | Kisboll | B24B 37/26 451/529 |
| 11,806,838 | B2 * | 11/2023 | Zu | B24D 11/04 |
| 2020/0094370 | A1 * | 3/2020 | Cherian | B24B 37/013 |
| 2020/0298368 | A1 * | 9/2020 | Osterheld | G06T 7/529 |
| 2021/0053180 | A1 * | 2/2021 | Yen | B24B 37/042 |

* cited by examiner

*Primary Examiner* — Joel D Crandall
(74) *Attorney, Agent, or Firm* — Harrity & Harrity, LLP

(57) ABSTRACT

Some implementations herein describe a chemical-mechanical planarization tool including a polishing pad. The chemical-mechanical planarization tool including the polishing pad may perform a polishing operation to a semiconductor substrate. The polishing operation may generate, along a perimeter of the semiconductor substrate, a roll-off profile that satisfies a threshold. The polishing pad includes two or more regions, where each region includes a different pad surface pattern. Each region including a different pad surface pattern may correspond to a different polishing rate. Techniques using the polishing pad having such zone and pad surface pattern combinations allow for a focused and a controlled polishing of the semiconductor substrate, including along the perimeter of the semiconductor substrate to tightly control the roll-off profile.

20 Claims, 17 Drawing Sheets

MULTI-PATTERN IN-PAD SURFACE FOR POLISH RATE CONTROL

BACKGROUND

A layer, a substrate, or a semiconductor wafer may be planarized using a polishing or planarizing technique such as chemical mechanical polishing/planarization (CMP). A CMP operation may include depositing a slurry (or polishing compound) onto a polishing pad. A semiconductor substrate may be mounted to and secured by a substrate carrier, which may rotate the semiconductor substrate as the semiconductor substrate is pressed against the polishing pad. The slurry and polishing pad act as an abrasive that polishes or planarizes one or more layers (e.g., metallization layers) of the semiconductor substrate as the semiconductor substrate is rotated. The polishing pad may also be rotated to ensure a continuous supply of slurry is applied to the polishing pad.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
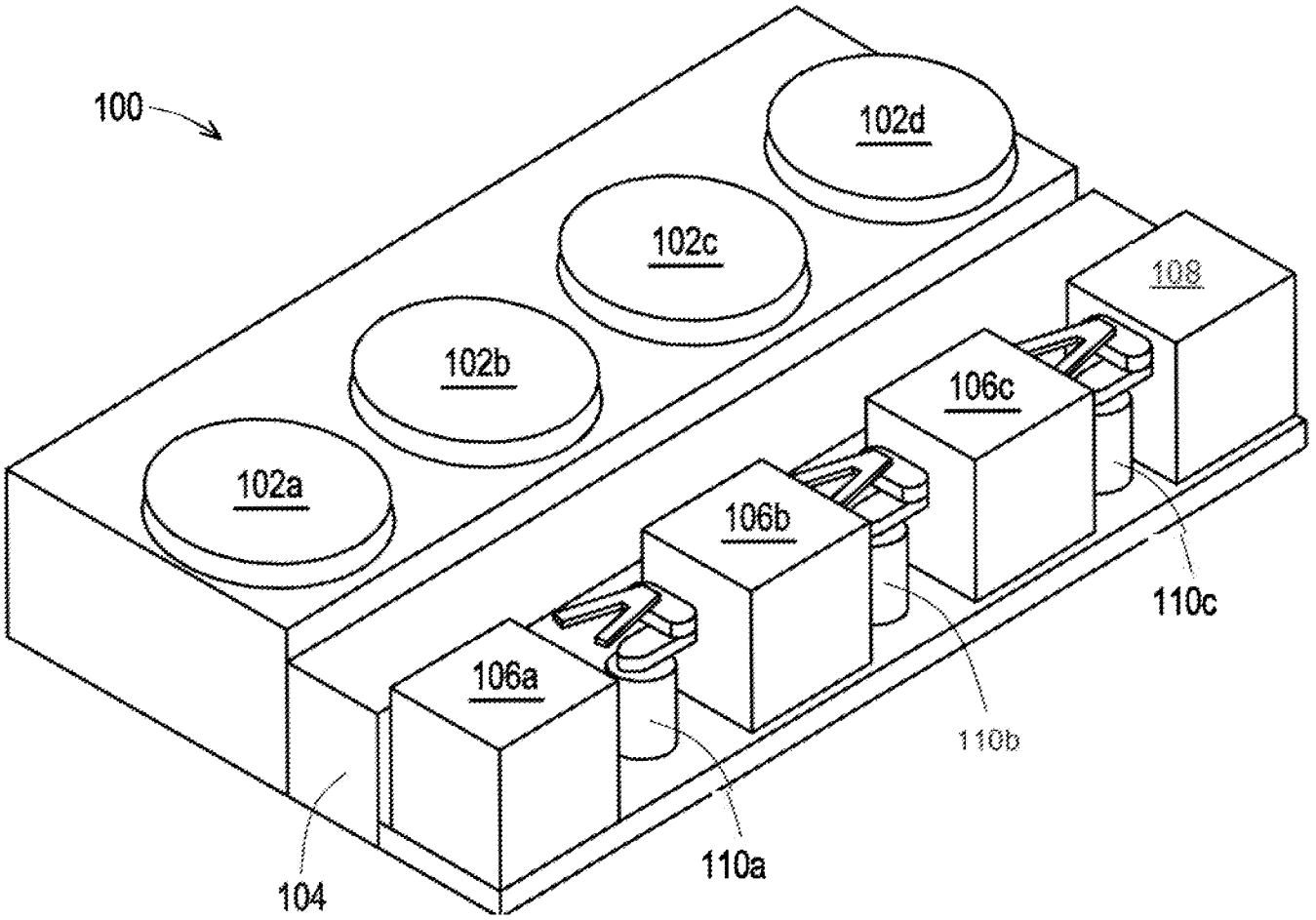
FIG. 1 is a diagram of an example chemical mechanical polishing/planarization (CMP) tool described herein.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In some cases, a semiconductor substrate may include a roll-off profile at or/near a perimeter of the semiconductor substrate. The roll-off profile may prevent the semiconductor substrate from being non-bonded to another semiconductor substrate in a semiconductor substrate stacking process. During a chemical-mechanical planarization (CMP) operation, a polishing pad including same patterns in a central region and a perimeter region may fail to sufficiently maintain the roll-off profile within a threshold that prevents inner non-bond failures from occurring during or after the semiconductor substrate stacking process. For example, a perimeter region higher than a bonding pad in the central region of a semiconductor substrate prevents the bonding pad from contacting another semiconductor substrate stacking above.

Some implementations herein describe a CMP tool including a polishing pad. The CMP tool including the polishing pad may perform a polishing operation to a semiconductor substrate. The polishing operation may generate, along a perimeter of the semiconductor substrate, a roll-off profile that satisfies a threshold. The polishing pad includes two or more regions, where each region includes a different pad surface pattern. Each region including a different pad surface pattern may correspond to a different polishing rate. Techniques using the polishing pad having such zone and pattern surface pattern combinations allow for a focused and a controlled polishing of the semiconductor substrate, including along the perimeter of the semiconductor substrate to tightly control the roll-off profile.

In this way, the roll-off profile of the semiconductor substrate may be consistently formed to improve a yield related to a semiconductor substrate stacking process. Additionally, an amount or resources needed to fabricate a volume of stacked semiconductor substrates (e.g., semiconductor manufacturing tools, materials, power, and/or supporting computing resources, among other examples) may be reduced relative to techniques that include polishing the semiconductor substrate using a CMP tool including a polishing pad with a single pattern.

FIG. 1 is a diagram of an example CMP tool 100 described herein. The CMP tool 100 includes a semiconductor processing tool that is capable of polishing or planarizing a semiconductor wafer, a semiconductor device, and/or another type of semiconductor substrate. The CMP tool 100 includes one or more processing chambers 102 in which layers and/or structures of a semiconductor substrate are polished or planarized. In some implementations, a processing chamber 102 is configured to polish or planarize a surface (or a layer or structure) of a semiconductor substrate with a combination of chemical and mechanical forces (e.g., chemical etching and free abrasive polishing). The CMP tool 100 is configured to utilize an abrasive and corrosive chemical slurry in conjunction with a polishing pad and retaining ring (e.g., typically of a greater diameter than the semiconductor substrate) in a processing chamber 102. To perform a CMP operation, the CMP tool 100 presses the polishing pad against the semiconductor substrate in the processing chamber 102 using a dynamic polishing head that is held in place by the retaining ring. The dynamic polishing head may rotate with different axes of rotation to remove material and even out any irregular topography of a layer or a structure of the semiconductor substrate, thereby making the layer or a structure of the semiconductor substrate flat or planar.

The CMP tool 100 includes a transfer chamber 104 in which semiconductor substrates are transferred to and from the processing chamber(s) 102. Moreover, semiconductor substrates are transferred between the transfer chamber 104 and one or more cleaning chambers 106 included in the CMP tool 100. A cleaning chamber 106 (also referred to as a CMP cleaning chamber or a post-CMP cleaning chamber) is a component of the CMP tool 100 that is configured to perform a post-CMP cleaning operation to clean or remove residual slurry and/or removed material from a semiconductor substrate that has undergone a CMP operation. In some implementations, the CMP tool 100 includes a plurality of cleaning chambers 106, and the CMP tool 100 is configured to process a semiconductor substrate through a plurality of sequential post-CMP cleaning operations in the plurality of cleaning chambers 106. As an example, the CMP tool 100 may process a semiconductor substrate in a first post-CMP cleaning operation in a cleaning chamber 106*a*, may process the semiconductor substrate in a second post-CMP cleaning operation in a cleaning chamber 106*b*, may process the semiconductor substrate in a third post-CMP cleaning operation in a cleaning chamber 106*c*, and so on.

A cleaning chamber 106 cleans a semiconductor substrate using a cleaning agent such as isopropyl alcohol (IPA), a chemical solution that includes a plurality of cleaning chemicals, and/or another type of cleaning agent. The CMP tool 100 includes one or more types of cleaning chambers 106. Each type of cleaning chamber 106 is configured to clean a semiconductor substrate using a different type of cleaning device. In some implementations, a cleaning chamber 106 includes a brush-type cleaning chamber. A brush-type cleaning chamber is a cleaning chamber that includes one or more cleaning brushes (or roller brushes) that are configured to spin or rotate to brush-clean a semiconductor substrate. In some implementations, a cleaning chamber 106 includes a pen-type cleaning chamber. A pen-type cleaning chamber is a cleaning chamber that includes a cleaning pen (or cleaning pencil) that is configured to provide fine-tuned and detailed cleaning of a semiconductor substrate.

In some implementations, the cleaning chambers 106 of the CMP tool 100 are arranged such that a semiconductor substrate is first processed in one or more brush-type cleaning chambers (e.g., to remove a large amount of removed material and residual slurry from the semiconductor substrate), and is then processed in a pen-type cleaning chamber (e.g., to provide detailed cleaning of structures and/or recesses in the semiconductor substrate). As an example, the cleaning chambers 106*a* and 106*b* may be configured as brush-type cleaning chambers, and cleaning chamber 106*c* may be configured as a pen-type cleaning chamber.

The CMP tool 100 includes a rinsing chamber 108 that is configured to rinse a semiconductor substrate after one or more post-CMP cleaning operations. The rinsing chamber 108 rinses a semiconductor substrate to remove residual cleaning agent from the semiconductor substrate. The rinsing chamber 108 is configured to use a rinsing agent, such as deionized water (DIW) or another type of rinsing agent, to rinse a semiconductor substrate. Semiconductor substrates are transferred to the rinsing chamber 108 from a cleaning chamber 106 directly or through the transfer chamber 104. In some implementations, a semiconductor substrate is processed in a drying operation in the rinsing chamber 108, in which the semiconductor substrate is dried to prevent oxidation and/or other types of contamination of the semiconductor substrate.

The CMP tool 100 includes a plurality of transport devices 110. The transport devices 110 include robot arms or other types of transport devices that are configured to transfer semiconductor substrates between the processing chamber(s) 102, the transfer chamber 104, the cleaning chamber(s) 106, and/or the rinsing chamber 108.

As described in greater connection with FIGS. 2A-10 and elsewhere herein, the CMP tool 100 may perform a series of operations related to polishing the semiconductor substrate. For example, the series of operations includes receiving a semiconductor substrate onto a polishing head over a polishing pad that includes a first region and a second region, where the first region includes a first set of properties related to a pad surface pattern, where the first set of properties corresponds to a first polishing rate for a first portion of a semiconductor substrate during a polishing operation using the polishing pad, where the second region includes a second set of properties related to the pad surface pattern, where the second set of properties corresponds to a second polishing rate for a second portion of the semiconductor substrate during the polishing operation, and where the second set of properties is different from the first set of properties. The method includes polishing the semiconductor substrate using the polishing pad.

Additionally, or alternatively, the series of operations includes rotating, concurrently, a polishing head holding a semiconductor substrate about a first axis and a platen holding a polishing pad having two or more pad surface patterns about a second axis, where the platen holding the polishing pad is below the substrate carrier, where rotating the polishing head about the first axis includes rotating the polishing head about a central axis of the polishing head using a first rotational vector, and where rotating the platen about the second axis includes rotating the platen about a central axis of the platen using a second rotational vector. The series of operations includes engaging the semiconductor substrate and the polishing pad. The series of operations includes polishing, concurrently, two or more regions of the semiconductor substrate using a polishing pad.

As indicated above, FIG. 1 is provided as an example. Other examples may differ from what is described with regard to FIG. 1.

Figure 2A:
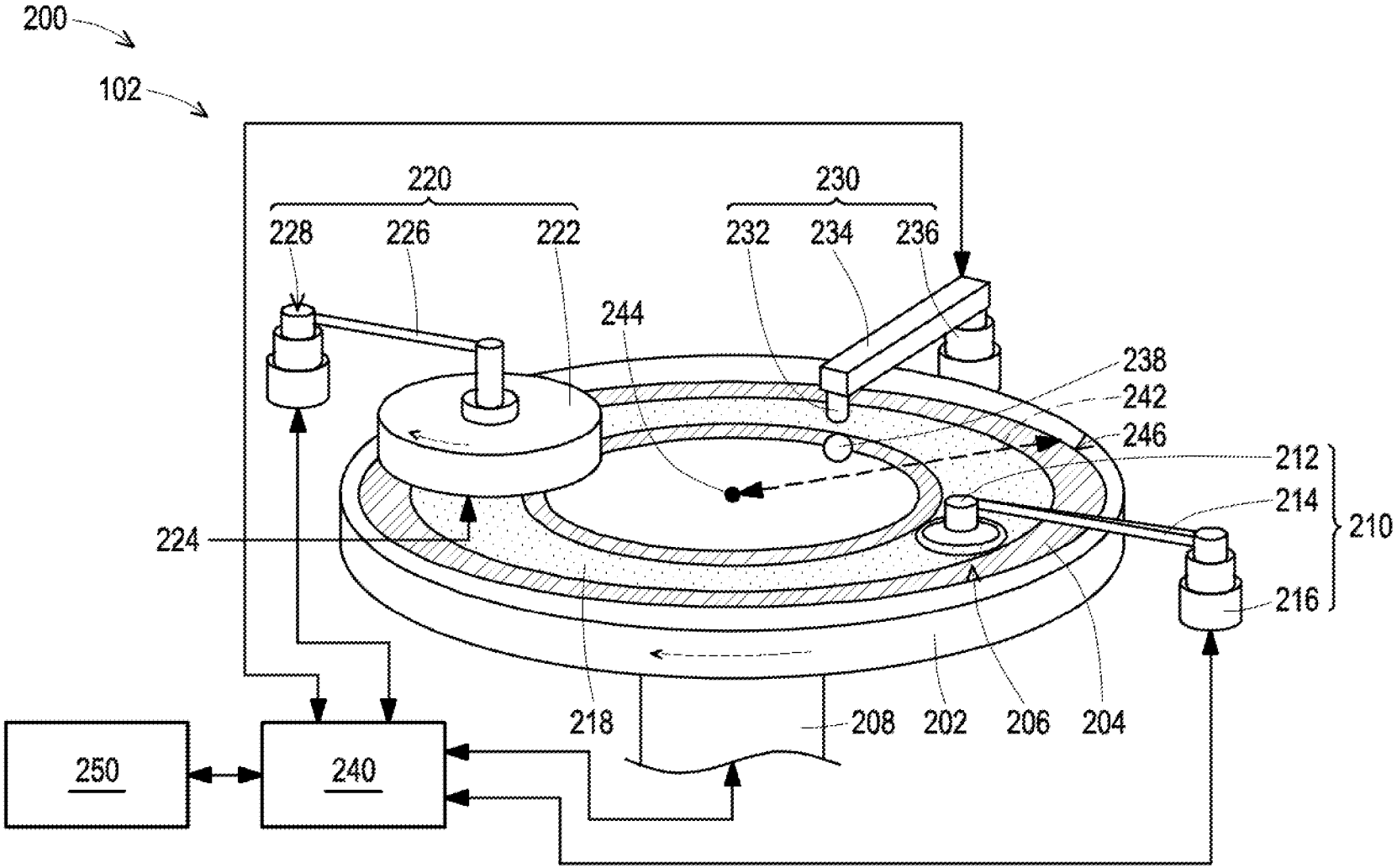
FIGS. 2A-2C are diagrams of example implementations of a processing chamber of the CMP tool of FIG. 1 described herein.
Figure 2B:
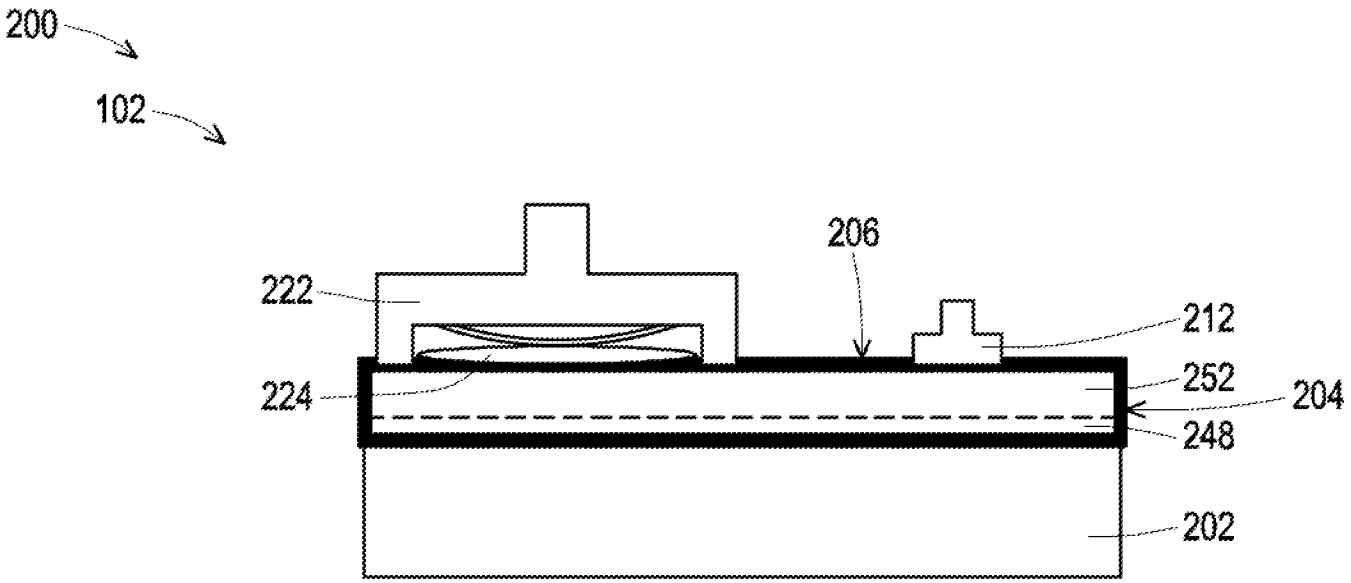
Figure 2C:
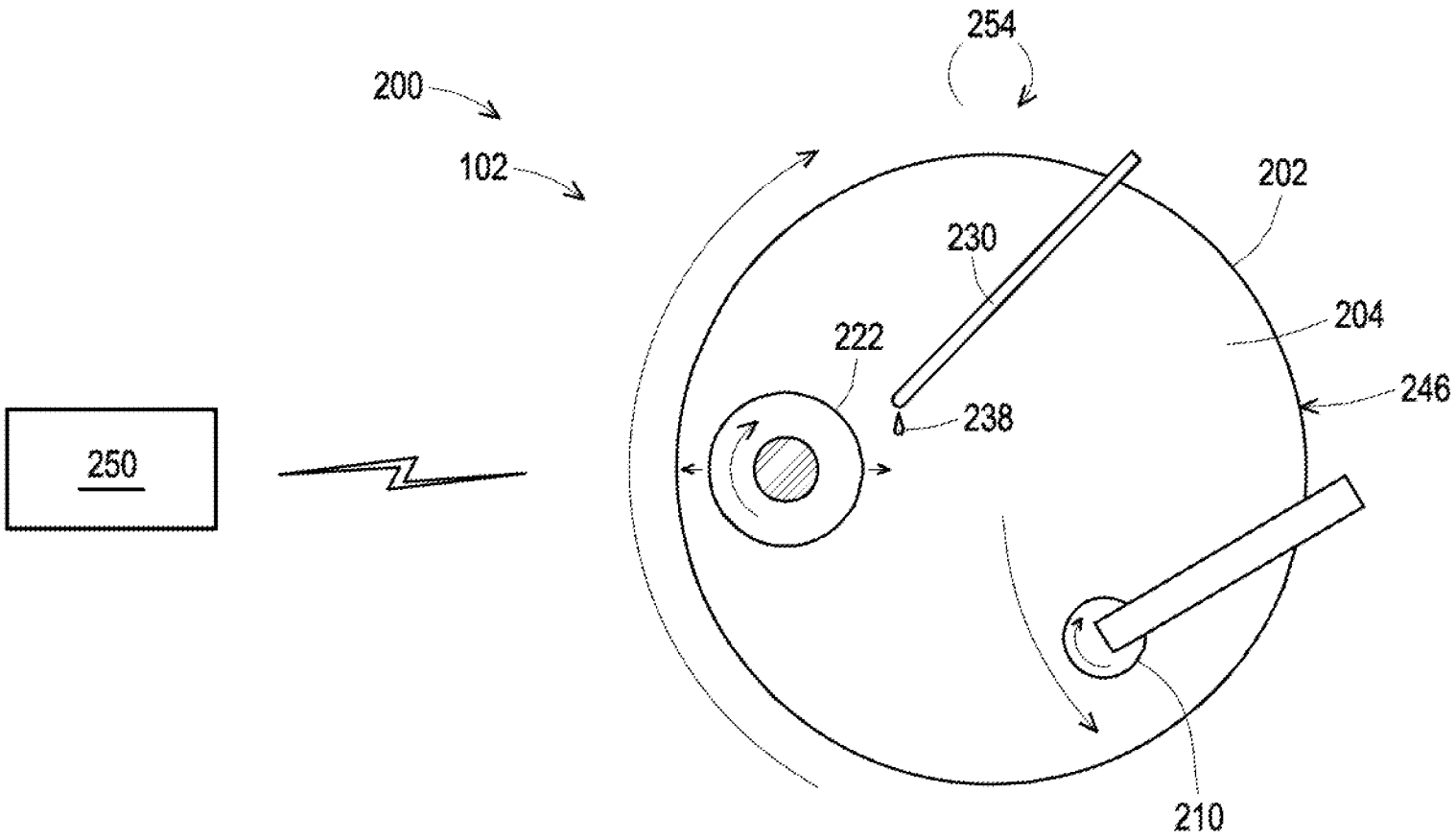

FIGS. 2A-2C are diagrams of example implementations 200 an example of a processing chamber of the CMP tool 100 described herein. In particular, FIGS. 2A-2C illustrate views inside the processing chamber 102.

FIG. 2A illustrates a perspective view inside the processing chamber 102. As shown in FIG. 2A, the processing chamber 102 includes various subsystems including a conditioner 210, a semiconductor substrate carrier 220, a slurry system 230, a motor assembly 240, and a CMP controller 250. The CMP controller 250 (e.g., a processor, a combination of a processor and memory, among other examples) may perform one or more functions related to related to controlling the CMP tool 100 and/or components within the processing chamber 102.

The processing chamber 102 further includes a platen 202 and a polishing pad 204. The polishing pad 204 is mounted on the platen 202 and has a polishing surface 206. The platen 202 is further coupled to a drive shaft 208.

The conditioner 210 includes a conditioning disk 212 which can be pivoted via an arm 214. The arm 214 is electrically connected to the motor assembly 240 through a shaft 216. The arm 214 is driven by the shaft 216 to move, for example, in a swing motion over a range 218 in a polishing operation (e.g., a CMP operation). Therefore, the conditioning disk 212 travels along the swing motion to condition different portions of the polishing surface 206. The conditioning disk 212 may be configured to rotate about an axis to restore asperities to the polishing surface 206 as the polishing operation makes the polishing surface 206 smoother. That is, in order to retain the material removal qualities of the polishing pad 204, the conditioning disk 212 is used to maintain roughness on the polishing surface 206 that would otherwise be lost during the polishing operation. The conditioning disk 212 carries an abrasive pad that may include, for example, a diamond abrasive.

The semiconductor substrate carrier 220 includes a polishing head 222 for mounting and securing a semiconductor substrate 224. The semiconductor substrate 224 may be mounted and secured to the polishing head 222 by a vacuum force or another type of securing force. The semiconductor substrate 224 is mounted to the polishing head 222 such that a surface of the semiconductor substrate 224 (e.g., a polishing surface, a processing surface, an active surface, a device surface) that is to be processed is orientated to face the polishing surface 206. The polishing head 222 may also be pivoted via an arm 226. The arm 226 is electrically connected to the motor assembly 240 through a shaft 228. In some implementations, the arm 226 may also be driven by the shaft 228 to move in a swing motion during the polishing operation. The polishing head 222 is configured to rotate about an axis of the polishing head 222 (e.g., an axis that is approximately perpendicular to the polishing surface 206) in the polishing operation.

The slurry system 230 includes a slurry supply 232 which can be pivoted via an arm 234. The arm 234 is electrically connected to the motor assembly 240 through a shaft 236. In some implementations, the arm 234 may also be driven by the shaft 236 to move in a swing motion in the polishing operation. The slurry system 230 can provide slurry 238 which may include an abrasive compound and a fluid such as deionized water, or a liquid cleaner such as potassium hydroxide (KOH), onto the polishing surface 206 of the polishing pad 204 before wafer planarization occurs. In an example, a flow rate of the slurry 238 may be in a range of approximately 50 milliliters (ml)/minute to approximately 350 ml/minute. However, other values for the range are within the scope of the present disclosure.

In the polishing operation, the motor assembly 240 rotates the platen 202 and the polishing pad 204 via the drive shaft 208. The slurry system 230 dispenses the slurry 238 onto the polishing surface 206. As the polishing pad 204 rotates, the conditioning disk 212 is rotated about a disk axis of the conditioning disk 212 and is driven to swing horizontally above the polishing surface 206 such that the conditioning disk 212 can condition the polishing surface 206 of the polishing pad 204. In some implementations, the conditioning disk 212 iteratively conditions the inner portions and the outer portions of the polishing surface 206. The motor assembly 240 also rotates a semiconductor substrate 224, mounted and secured by the polishing head 222, through the arm 226 and the shaft 228. A down-force is controlled by the CMP controller 250 to move the active surface of the semiconductor substrate 224 onto the polishing surface 206. In this configuration, the conditioning disk 212 scratches or roughs up the polishing surface 206 of the polishing pad 204 continuously during the CMP process to promote consistent and/or uniform polishing. The combination of motions of the conditioner 210, the polishing head 222, and the slurry system 230 planarizes the active surface of the semiconductor substrate 224 until an endpoint for the CMP process is reached, which may include a particular time duration of the CMP process, a particular amount of material removed from the semiconductor substrate 224, or another endpoint.

In some implementations, the polishing surface 206 includes a plurality of groove segments and/or geometric patterns formed by the plurality of groove segments configured in a pad surface pattern region 242 of the polishing pad 204. During the CMP process, all or a portion of the plurality of groove segments and/or geometric patterns formed by the plurality of groove segments impede a trajectory of the slurry (hereinafter referred to as a slurry trajectory). Specifically, all or a portion of the plurality of groove segments and/or geometric patterns formed by the plurality of groove segments are configured to impede a radial flow of the slurry 238 from a center 244 of the polishing pad 204 (or from an area of the polishing pad 204 in which the slurry 238 is dispensed) to a polishing pad outer edge 246. Impeding the slurry trajectory promotes retention of the slurry 238 on the polishing surface 206 of the polishing pad 204. By impeding the slurry trajectory, a retention time or duration of time the slurry is present on the polishing pad is increased. Increasing the retention of the slurry results in a more predictable and controlled CMP process and reduces slurry waste.

In some implementations, the slurry 238 is dispensed onto the pad surface pattern region 242 of the polishing pad 204. The rotation of the polishing pad 204 creates forces that direct the slurry 238 toward the polishing pad outer edge 246. Patterns formed by the plurality of in the pad surface pattern region 242 of the polishing pad 204 alters the slurry trajectory across the polishing pad 204.

FIG. 2B is a cross-sectional view inside the processing chamber 102 described herein. As shown in FIG. 2B, the polishing pad 204 may include a pad base 248 and a pattern layer 252. In some implementations, the pattern layer 252 may be supported by the pad base 248, which may be formed integrally with pattern layer 252 or may be formed separately from the pattern layer 252. The polishing pad 204 may have a circular disk shape with the polishing surface 206 formed thereon. The pattern layer 252 includes the polishing surface 206 thereon. The pattern layer 252 may be formed from any material suitable for polishing an article to be polished, such as the semiconductor substrate 224. Examples of materials for the pattern layer 252 include various polymer plastics, such as a polyurethane, polybutadiene, polycarbonate and polymethylacrylate, among other examples.

FIG. 2C is a diagram of an example polishing operation 254 performed in the processing chamber 102. In some implementations, the polishing head 222 mounts and secures the semiconductor substrate 224. The slurry system 230 applies the slurry 238 to the polishing pad 204. The conditioner 210 spreads the slurry 238 across the polishing pad 204 while the polishing pad 204 is in motion. In the polishing operation 254, the polishing pad 204 and the polishing head 222 rotate and/or oscillate to perform a polishing (e.g., a planarization) of the semiconductor substrate 224. The polishing operation 254 removes an amount, for example the excess thickness, of a layer on the semiconductor substrate 224. The polishing operation 254 includes dispensing the slurry 238 onto the polishing pad 204, and rotating the polishing pad 204, where rotation of the polishing pad 204 results in a slurry trajectory of the slurry 238 radially outward toward the polishing pad outer edge 246 of the polishing pad 204.

In some implementations, the CMP controller 250 adjusts one or more parameters associated with the polishing operation 254 using a machine learning model. The machine learning model may include and/or may be associated with one or more of a neural network model, a random forest model, a clustering model, or a regression model, among other examples. In some implementations, the CMP controller 250 uses the machine learning model by providing candidate parameters including a rotational vector related to the platen 202, a rotational vector related to the polishing head 222, a flow rate of the slurry 238, and/or a compressive force between the polishing pad 204 and the semiconductor substrate 224, among other examples, as input to the machine learning model. The CMP controller 250 may use machine learning model to determine a likelihood, probability, or confidence that a particular outcome (e.g., a roll-off profile at a perimeter region of the semiconductor substrate 224, among other examples) for a subsequent polishing operation will be achieved using the candidate parameters. In some implementations, the CMP controller 250 provides a target roll-off profile as input to the machine learning model, and the CMP controller 250 uses the machine learning model to determine or identify a particular combination of a rotational vector related to the platen 202, a rotational vector related to the polishing head 222, a flow rate of the slurry 238, and/or a compressive force between the polishing pad 204 and the semiconductor substrate 224, among other examples, that is likely to achieve the target roll-off profile.

The CMP controller 250 (or another system) may train, update, and/or refine the machine learning model to increase the accuracy of the outcomes and/or parameters determined using the machine learning model. The CMP controller 250 may train, update, and/or refine the machine learning model based on feedback and/or results from the subsequent polishing operation, as well as from historical or related polishing operations (e.g., from hundreds, thousands, or more historical or related polishing operations performed by the CMP tool 100.

As described in greater detail in connection with FIGS. 3-10, and elsewhere herein, a system corresponding the CMP tool 100 (including the processing chamber 102) includes the polishing pad 204 over the platen 202. The polishing pad 204 includes a first pad surface pattern occupying a first region of the polishing pad 204, where the first pad surface pattern corresponds to a first polishing rate for a first portion of a semiconductor substrate 224 during a polishing operation using the polishing pad 204. The polishing pad 204 includes a second pad surface pattern occupying a second region of the polishing pad 204, where the second pad surface pattern is different from the first pad surface pattern, and where the second pad surface pattern corresponds to a second polishing rate for a second portion of the semiconductor substrate 224 during the polishing operation using the polishing pad 204.

As indicated above, FIGS. 2A-2C are provided as examples. Other examples may differ from what is described with regard to FIGS. 2A-2C.

Figure 3:
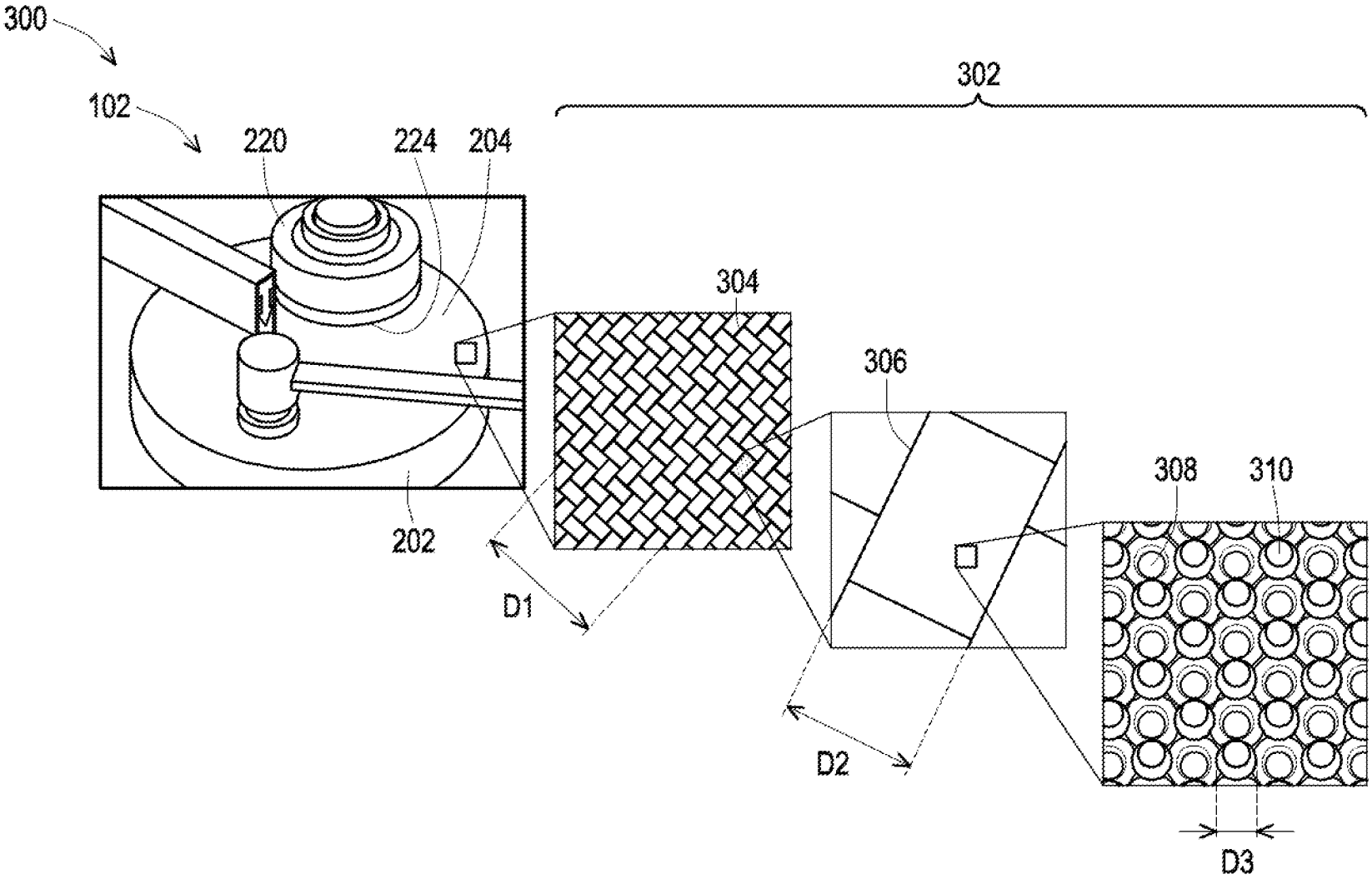
FIG. 3 is a diagram of an example implementations of features included in a pad surface pattern described herein.

FIG. 3 is a diagram of an example implementation 300 of features included in a pad surface pattern 302 described herein. The pad surface pattern 302 may be included in the polishing pad 204 on the platen 202 within the processing chamber 102. In some implementations, variations of the pad surface pattern 302 are formed within different regions of the polishing pad 204 (e.g., within the pattern layer 252).

As shown in FIG. 3, the pad surface pattern 302 may include a combination of features including a groove 304, a unit 306, a pore 308, and/or an asperity 310, among other examples. Two or more the features may be formed from a same combination of one or more materials (e.g., a same combination of one or more of a polyurethane, polybutadiene, polycarbonate and/or polymethylacrylate material, among other examples). Additionally, or alternatively, two or more of the features may include a different combination of the one or more materials (e.g., a different combination of one or more of a polyurethane, polybutadiene, polycarbonate and/or polymethylacrylate material, among other examples).

The groove 304, the unit 306, the pore 308, and/or the asperity 310 may include a quality such as a hardness related to a selected combination of materials. Additionally, or alternatively, the groove 304, the unit 306, the pore 308, and/or the asperity 310, may include another quality such as a dimension. For example, and in some implementations, a width D1 of the pore 308 and/or the asperity 310 is included in a range of approximately 0 microns (μm) to approximately 100 μm. Additionally, or alternatively, a width D2 of the unit 306 may be included in a range of approximately 1 millimeter (mm) to approximately 5 millimeters. Additionally, or alternatively, a length D3 of the groove 304 may be included in a range of approximately 0 mm to approximately 300 mm. However, other values and ranges for the width D1, the width D2, and the length D3 are within the scope of the present disclosure.

In some implementations, a difference in a quality of the pad surface pattern 302 (e.g., a hardness of a feature, a dimension of a feature, a feature density (e.g., pattern density), an area of the pad surface pattern 302, or a location of the pad surface pattern 302, among other examples) may correspond to a different polishing rate (e.g., a different rate of material removal in angstroms (Å) per minute, among other examples) at different portions of the semiconductor substrate 224. Additionally, or alternatively, a difference in a quality of the pad surface pattern 302 may correspond to a same polishing rate at different portions of the semiconductor substrate 224. Additionally, or alternatively, a polishing rate may be dependent on rotational vectors of the platen 202 (e.g., the polishing pad 204) and/or the polishing head 222 (e.g., the semiconductor substrate 224).

As indicated above, FIG. 3 is provided as an example. Other examples may differ from what is described with regard to FIG. 3.

FIGS. 4A-4D are diagrams of example implementations 400 of the polishing pad 204 described herein. In the example implementations 400, different combinations of features (e.g., different combinations of the groove 304, the unit 306, the pore 308, and/or the asperity 310) may be included in pad surface pattern(s) 302 of the polishing pad 204. Additionally, or alternatively, different combinations of dimensions (e.g. the width D1, the width D2, and/or the length D3) may be associated with the different combinations of features. Additionally, or alternatively, a different pad surface pattern density may be associated with the different combinations of features.

Figure 4A:
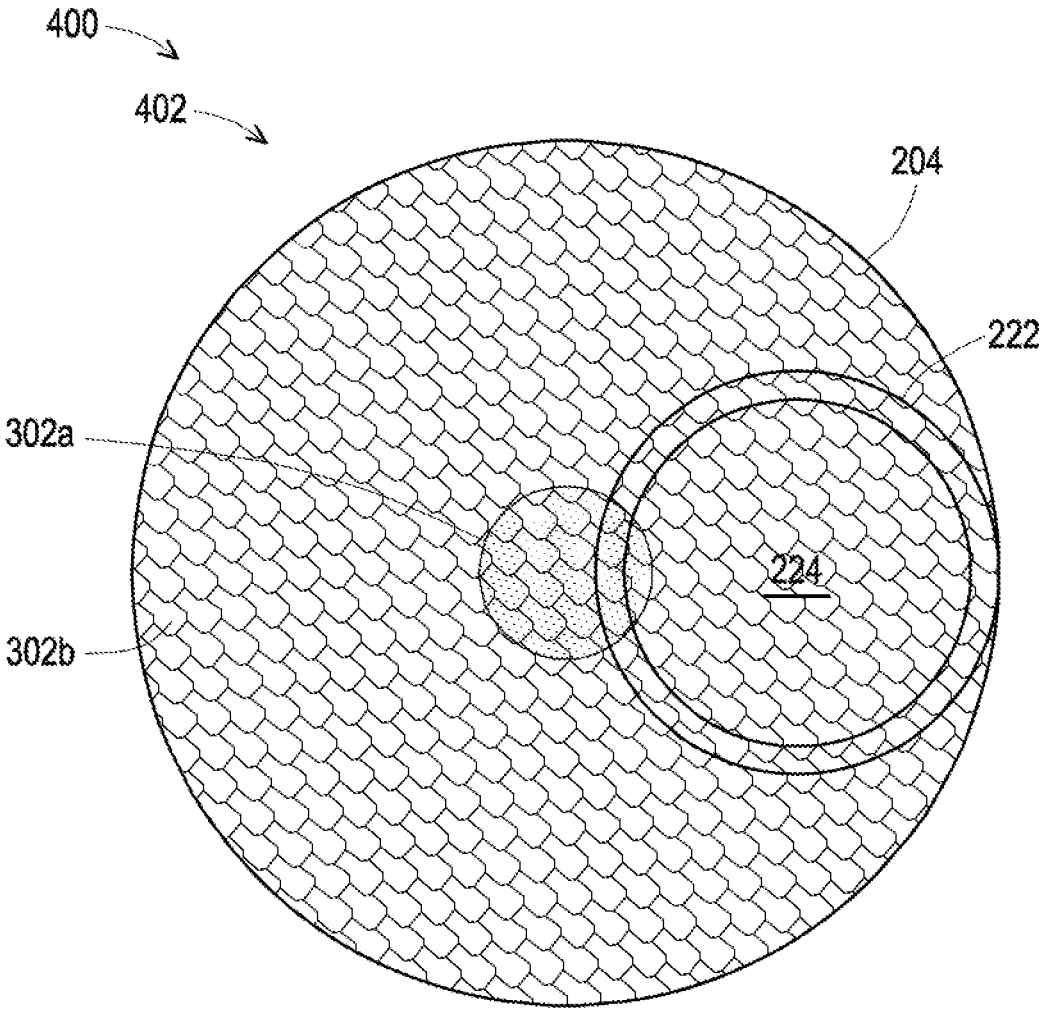
FIGS. 4A-4E are diagrams of example implementations of the polishing pad described herein.

As shown in example 402 of FIG. 4A, the polishing pad 204 may include the pad surface pattern 302*a* occupying a central portion of the polishing pad 204. Additionally, or alternatively and as shown in example 402, the polishing pad 204 may include the pad surface pattern 302*b* occupying a remaining region of the polishing pad 204. Polishing rates for different portions of the semiconductor substrate 224 (e.g., a polishing rate for an edge portion of the semiconductor substrate 224 and a polishing rate for a central portion of the semiconductor substrate 224, among other examples), may be based on qualities of the pad surface patterns 302*a* and 302*b*.

Figure 4B:
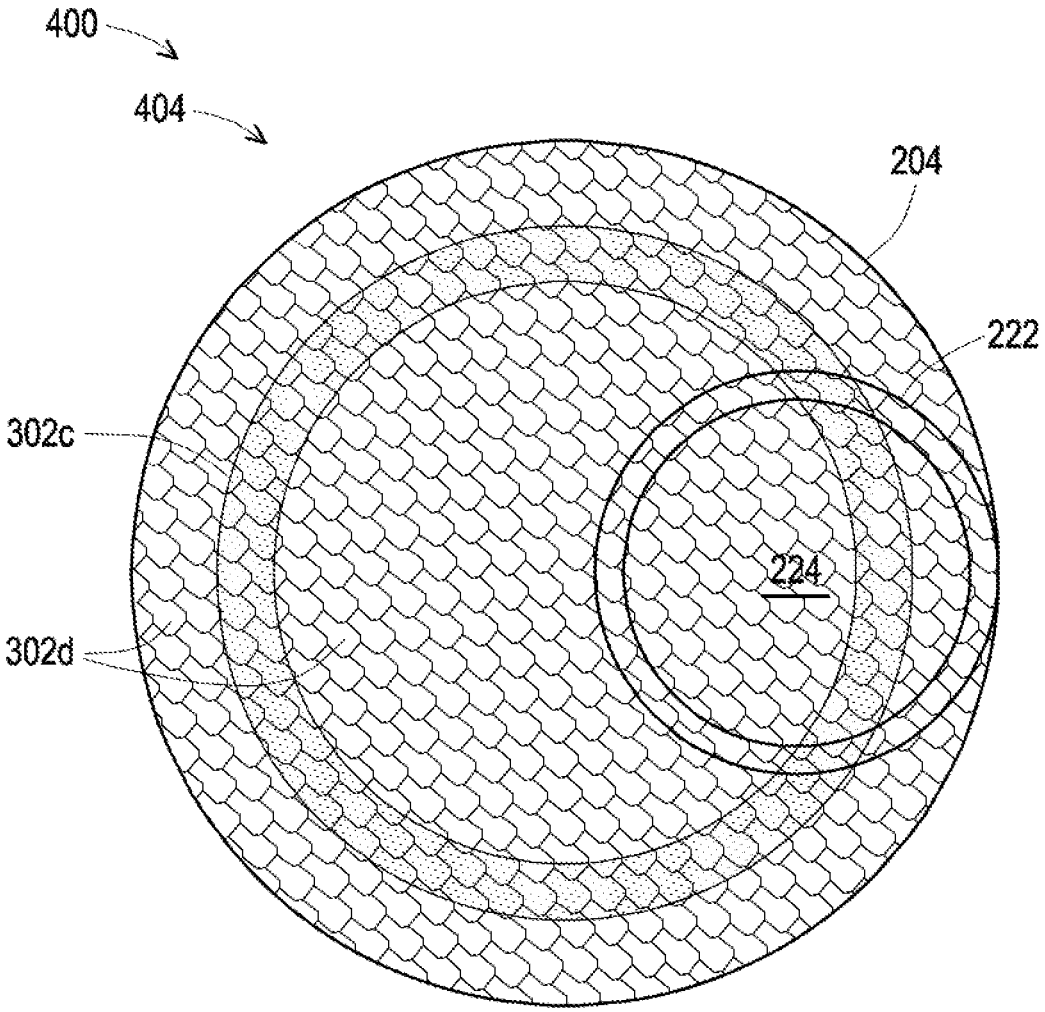

As shown in example 404 of FIG. 4B, the polishing pad 204 may include the pad surface pattern 302*c* occupying a ring-shaped region of the polishing pad 204. Additionally, or alternatively and as shown in example 404, the polishing pad 204 may include the pad surface pattern 302*d* occupying remaining regions of the polishing pad 204. Polishing rates for different portions of the semiconductor substrate 224 (e.g., the polishing rate for the edge portion of the semiconductor substrate 224 and the polishing rate for the central portion of the semiconductor substrate 224, among other examples), may be based on qualities of the pad surface patterns 302*c* and 302*d*.

Figure 4C:
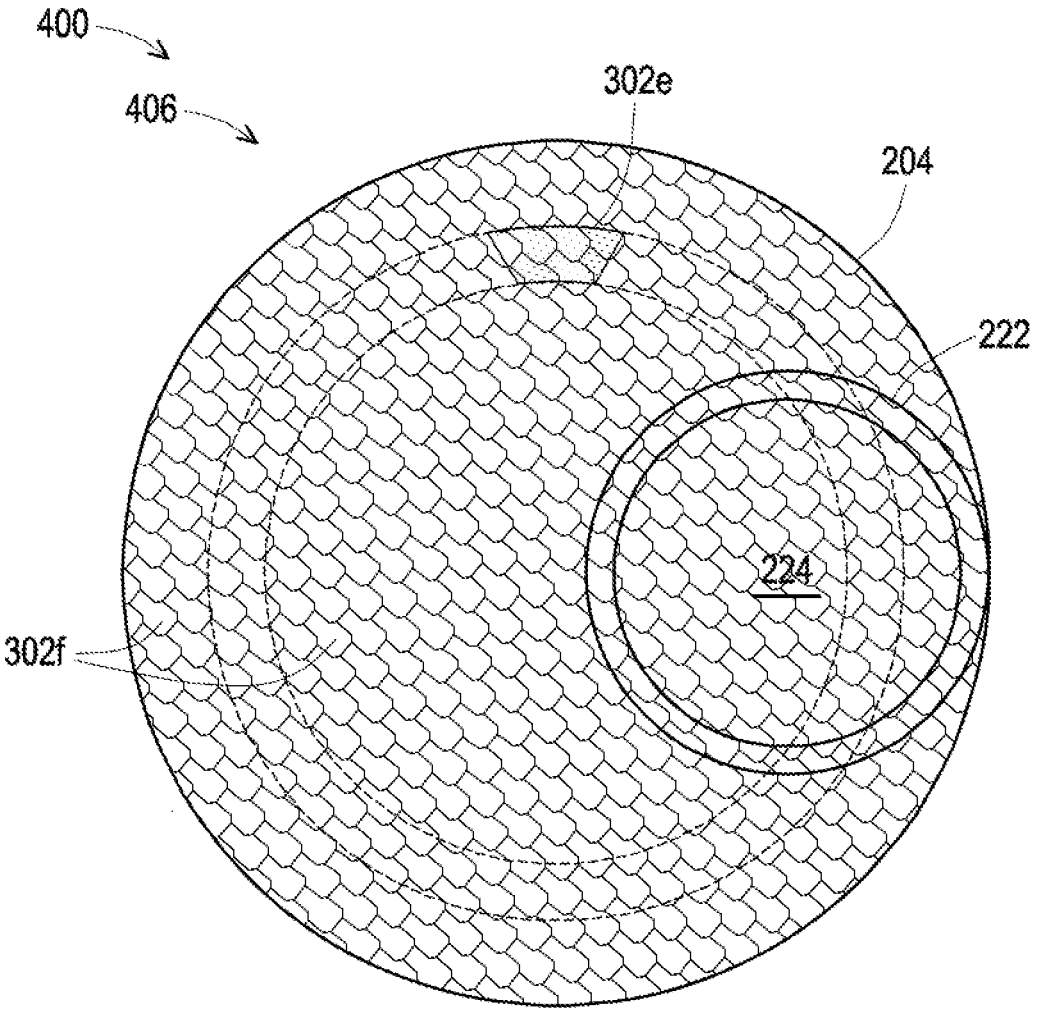

As shown in example 406 of FIG. 4C, the polishing pad 204 may include the pad surface pattern 302*d* occupying a segment of a ring-shaped region of the polishing pad 204. Additionally, or alternatively and as shown in example 406, the polishing pad 204 may include the pad surface pattern 302*f* occupying a remaining region of the polishing pad 204. Polishing rates for different portions of the semiconductor substrate 224 (e.g., the polishing rate for the edge portion of the semiconductor substrate 224 the polishing rate for a central portion of the semiconductor substrate 224, among other examples), may be based on qualities of the pad surface patterns 302*e* and 302*f*.

Figure 4D:
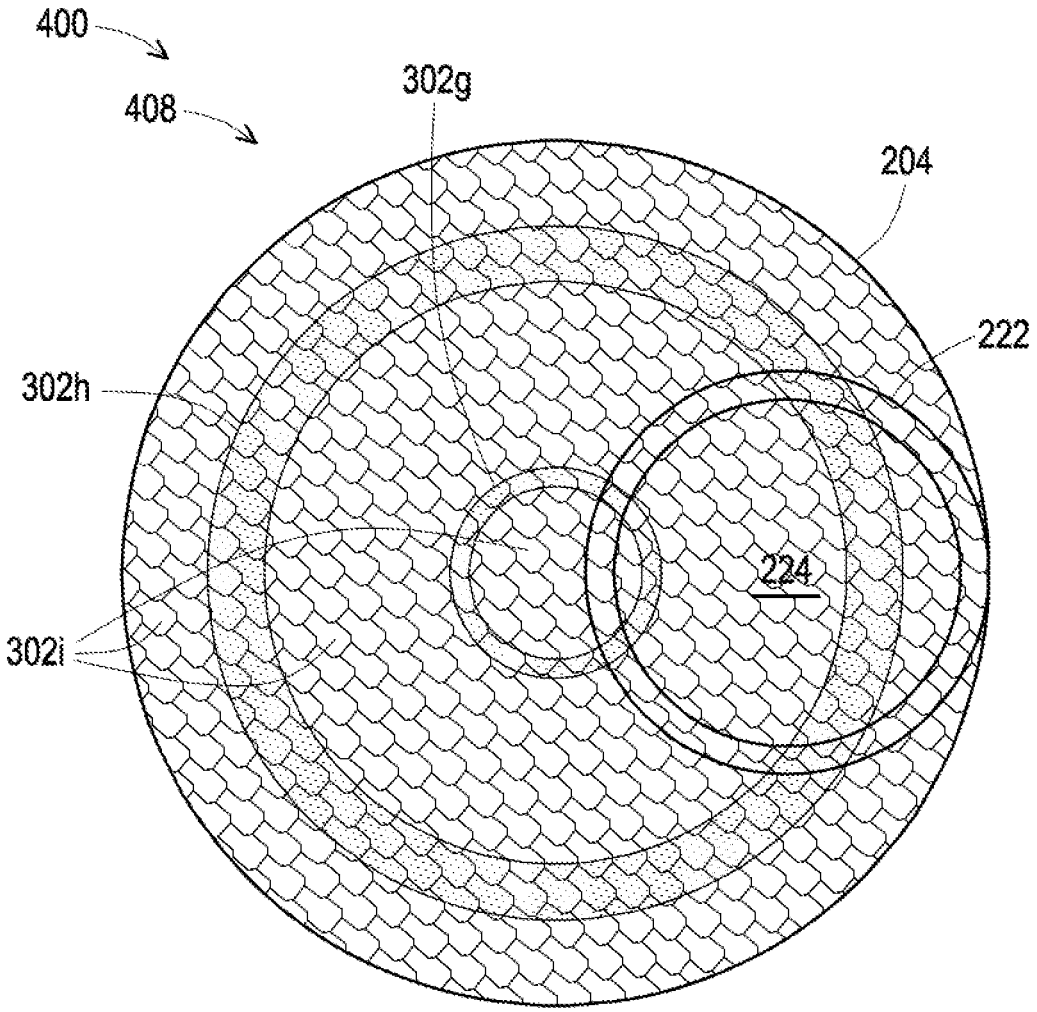

As shown in example 408 of FIG. 4D, the polishing pad 204 may include the pad surface pattern 302*g* occupying a first ring-shaped region of the polishing pad 204. Additionally, or alternatively and as shown in example 408, the polishing pad 204 may include the pad surface pattern 302*i* occupying a second ring-shaped region of the polishing pad 204. Additionally, or alternatively and as shown in example 408, the polishing pad 204 may include the pad surface pattern 302*i* occupying remaining regions of the polishing pad 204. Polishing rates for different portions of the semiconductor substrate 224 (e.g., the polishing rate for the edge portion of the semiconductor substrate 224 and the polishing rate for the central portion of the semiconductor substrate 224, among other examples), may be based on qualities of the pad surface pattern 302*g*. 302*h*, and 302*i*.

Figure 4E:
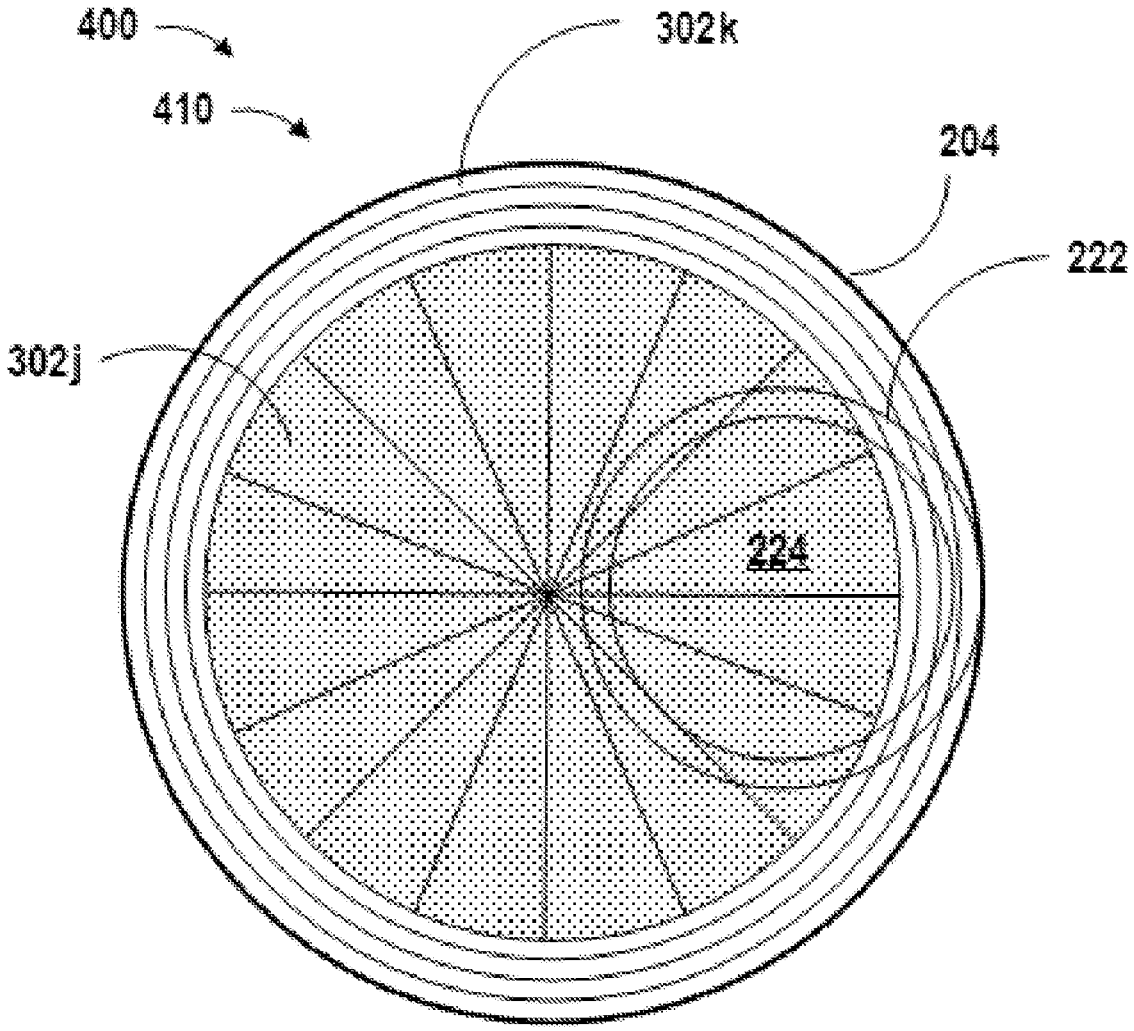

As shown in example 410 of FIG. 4E, the polishing pad 204 may include the pad surface pattern 302*j* occupying an inner region of the polishing pad 204. The pad surface pattern 302*j* may include, for example, one or more grooves arranged radially (e.g., one or more of the grooves 304 arranged concentrically). Additionally, or alternatively and as shown in example 410, the polishing pad 204 may include the pad surface pattern 302*k* occupying an outer ring-shaped region of the polishing pad 204. The pad surface pattern 302*k* may include, for example, one or more grooves arranged concentrically (e.g., one or more of the grooves 304 arranged concentrically). Polishing rates for different portions of the semiconductor substrate 224 (e.g., the polishing rate for the edge portion of the semiconductor substrate 224 and the polishing rate for the central portion of the semiconductor substrate 224, among other examples), may be based on qualities of the pad surface pattern 302*j* and 302*k*.

As indicated above, FIGS. 4A-4E are provided as an example. Other examples may differ from what is described with regard to FIGS. 4A-4E.

Figure 5A:
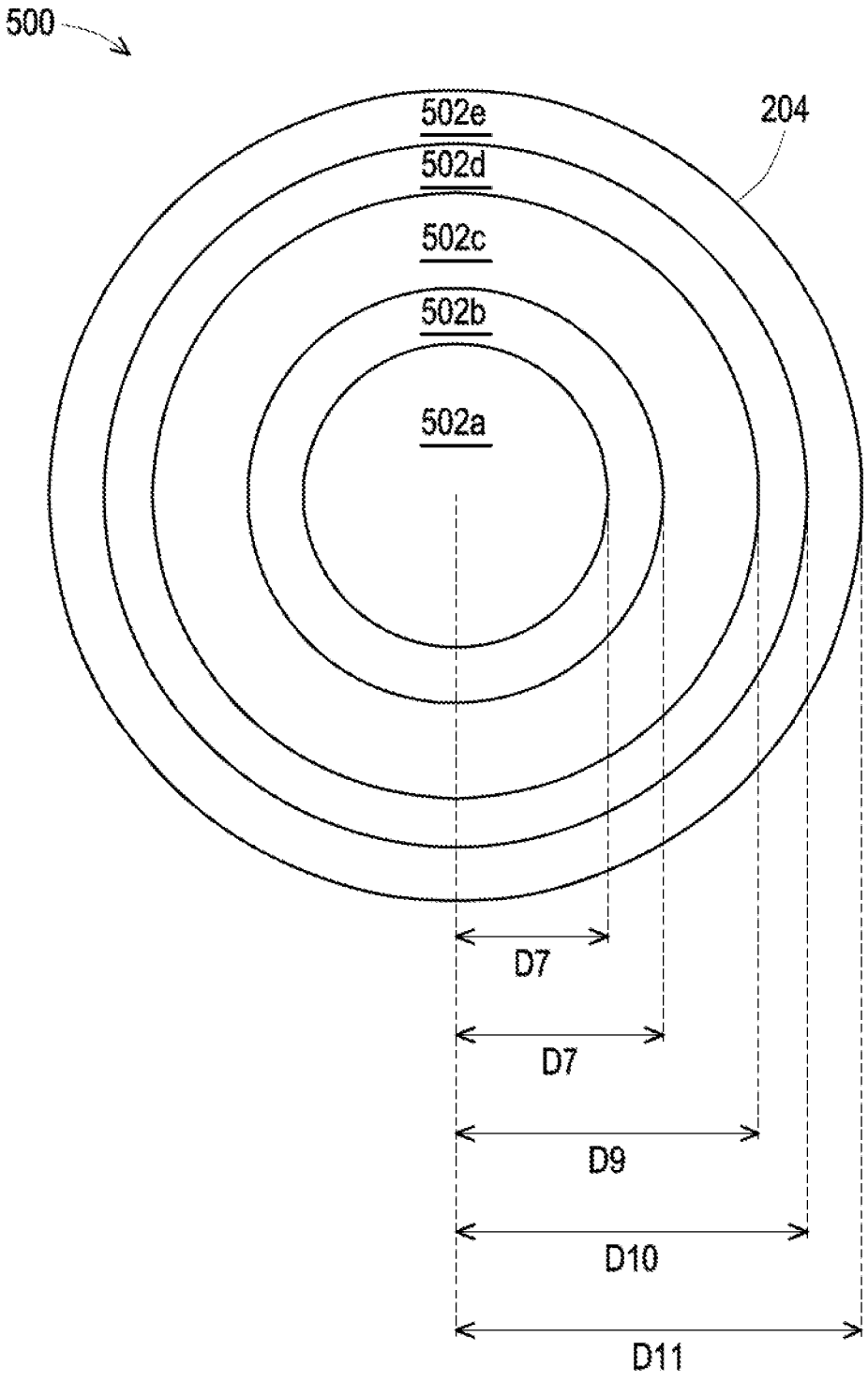
FIGS. 5A and 5B are diagrams of example implementations of a polishing pad including gradient zones described herein.
Figure 5B:
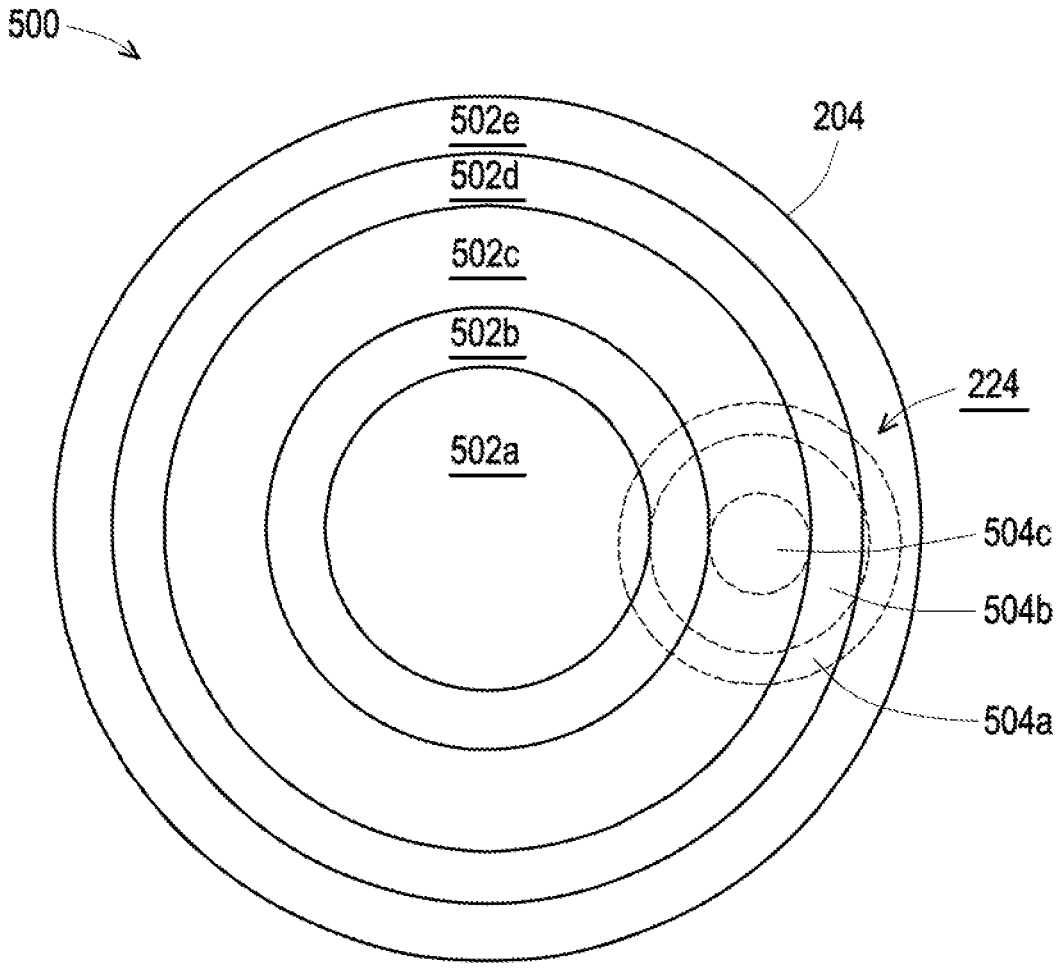

FIGS. 5A and 5B are diagrams of example implementations 500 of a polishing pad 204 including gradient zones described herein. Using variations of the pad surface pattern 302 as described in connection with FIG. 3 and elsewhere herein, a CMP tool (e.g., the CMP tool 100) including the polishing pad 204 having gradient zones may control a polishing rate across one or more portions of a semiconductor substrate (e.g., the semiconductor substrate 224).

FIG. 5A shows an example distribution of the gradient zones 502*a*-502*e*. As an example, gradient zone 502*a* may extend from the center of the polishing pad 204 a radial distance D7 included in a range of approximately 38.0 millimeters to approximately 42.0 millimeters (mm). In some implementations, the gradient zone 502*a* includes a pad surface pattern (e.g., the pad surface pattern 302) with one or more first qualities corresponding to a first polishing rate. In some implementations, a central region of the polishing pad 204 may include or correspond to the gradient zone 502*a*.

Additionally, or alternatively, gradient zone 502*b* may extend from the center of the polishing pad 204 a radial distance D8 that is included in a range of approximately 98.0 mm to approximately 102 mm (e.g., the gradient zone 502*b* is a ring-shaped zone having an inner radius included in a range of approximately 38.0 mm approximately 42.0 mm and an outer radius included in a range of approximately 98.0 mm to approximately 102.0 mm). In some implementations, the gradient zone 502*b* includes a pad surface pattern (e.g., the pad surface pattern 302) with one or more second qualities corresponding to a second polishing rate.

Additionally, or alternatively, gradient zone 502*c* may extend from the center of the polishing pad 204 a radial distance D9 that is included in a range of approximately 128.0 mm to approximately 132.0 mm (e.g., the gradient zone 502*c* is a ring-shaped zone having an inner radius included in a range of approximately 98.0 mm to approximately 102.0 mm and an outer radius included in a range of approximately 128.0 mm to approximately 132.0 mm). In some implementations, the gradient zone 502*c* includes a pad surface pattern (e.g., the pad surface pattern 302) with one or more third qualities corresponding to a third polishing rate.

Additionally, or alternatively, gradient zone 502*d* may extend from the center of the polishing pad 204 a radial distance D10 that is included in a range of approximately 143.0 mm to approximately 147.0 mm (e.g., the gradient zone 502*d* is a ring-shaped zone having an inner radius included in a range of approximately 128.0 mm to approximately 132.0 mm and an outer radius included in a range of approximately 143.0 mm to approximately 147.0 mm). In some implementations, the gradient zone 502*d* includes a pad surface pattern (e.g., the pad surface pattern 302) with one or more fourth qualities corresponding to a fourth polishing rate.

Additionally, or alternatively, gradient zone 502*e* may extend from the center of the polishing pad 204 a radial distance D11 that is included in a range of approximately 148.0 mm to approximately 152.0 mm (e.g., the gradient zone 502*e* is a ring-shaped zone having an inner radius included in a range of approximately 143.0 mm to approximately 147.0 mm and an outer radius included in a range of approximately 148.0 mm to approximately 152.0 mm). In some implementations, the gradient zone 502*e* includes a pad surface pattern (e.g., the pad surface pattern 302) with one or more fifth qualities corresponding to a fifth polishing rate. In some implementations, a perimeter region of the polishing pad 204 may correspond to, or include, the gradient zone 502*c*.

Turning to FIG. 5B, an outline of the semiconductor substrate 224 shows an outer portion 504*a*, a middle portion 504*b*, and an inner portion 504*c* of the semiconductor substrate 224. In a polishing operation (e.g., such as the polishing operation 254 of FIG. 2, among other examples), the outer portion 504*a* of the semiconductor substrate 224 may, at different rotational locations of the semiconductor substrate 224 and/or the polishing pad 204, be polished by each of the gradient zones 502*a*-502*e*. Additionally, or alternatively and during such a polishing operation, the middle portion 504*b* of the semiconductor substrate 224 may be polished by the gradient zones 502*b*-502*d*. Additionally, or alternatively and during such a polishing operation, the inner portion 504*c* may be polished by the gradient zone 502*c*.

As described in greater detail in connection with FIGS. 6A-6B and elsewhere herein, the polishing pad 204 and/or the semiconductor substrate 224 may be rotated during a polishing operation. Rotational vectors (e.g., a velocity of rotation in conjunction with a direction of rotation) and one or more qualities of a pad surface pattern (e.g., the pad surface pattern 302) within the gradient zones 502*a*-502*e* may be altered to tune a polishing rate for each of the portions 504*a*-504*c* across the semiconductor substrate 224.

As indicated above, FIGS. 5A and 5B are provided as examples Other examples may differ from what is described with regard to FIGS. 5A and 5B.

Figure 6A:
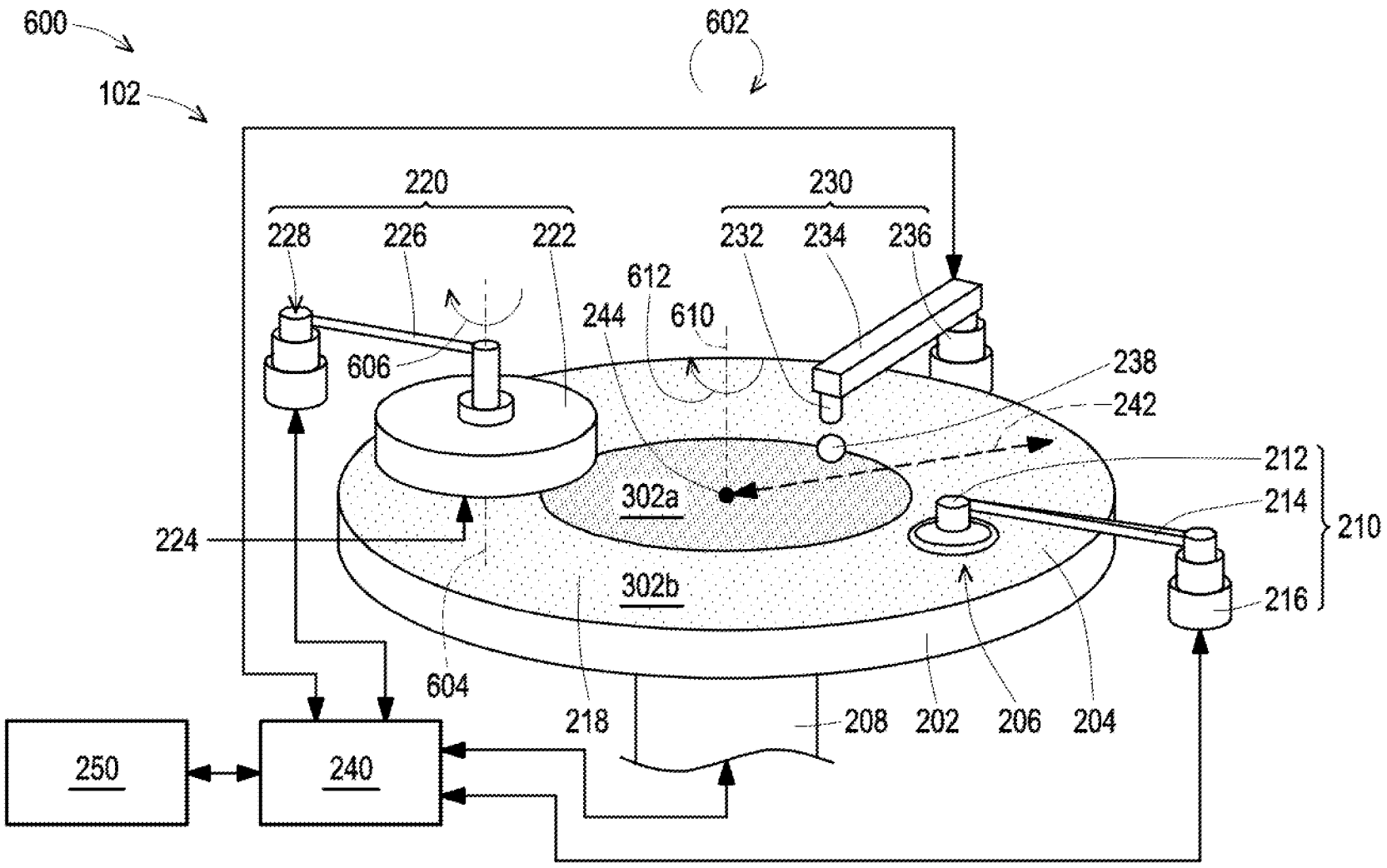
FIGS. 6A-6C are diagrams of an example series of operations using the polishing pad described herein.
Figure 6B:
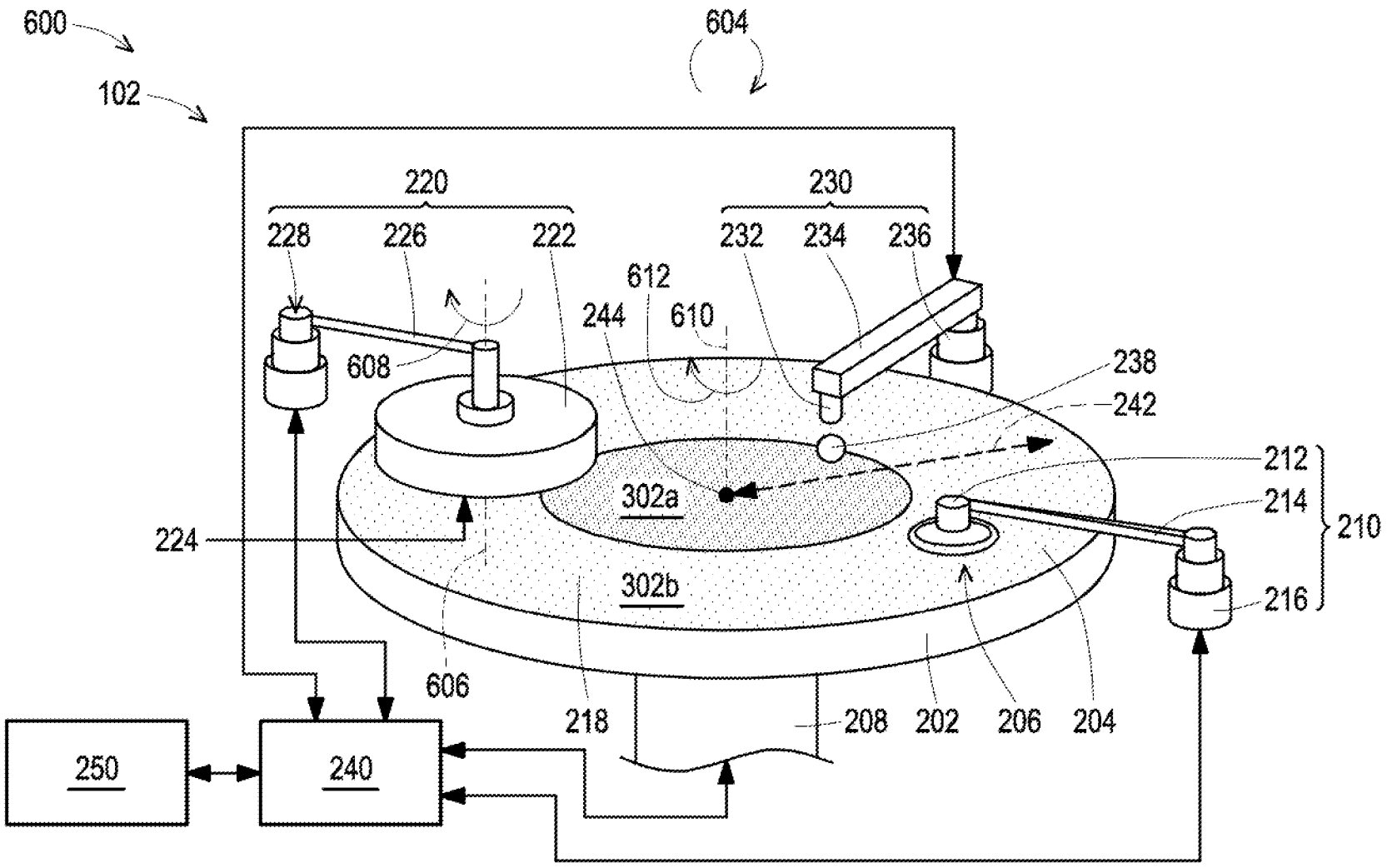
Figure 6C:
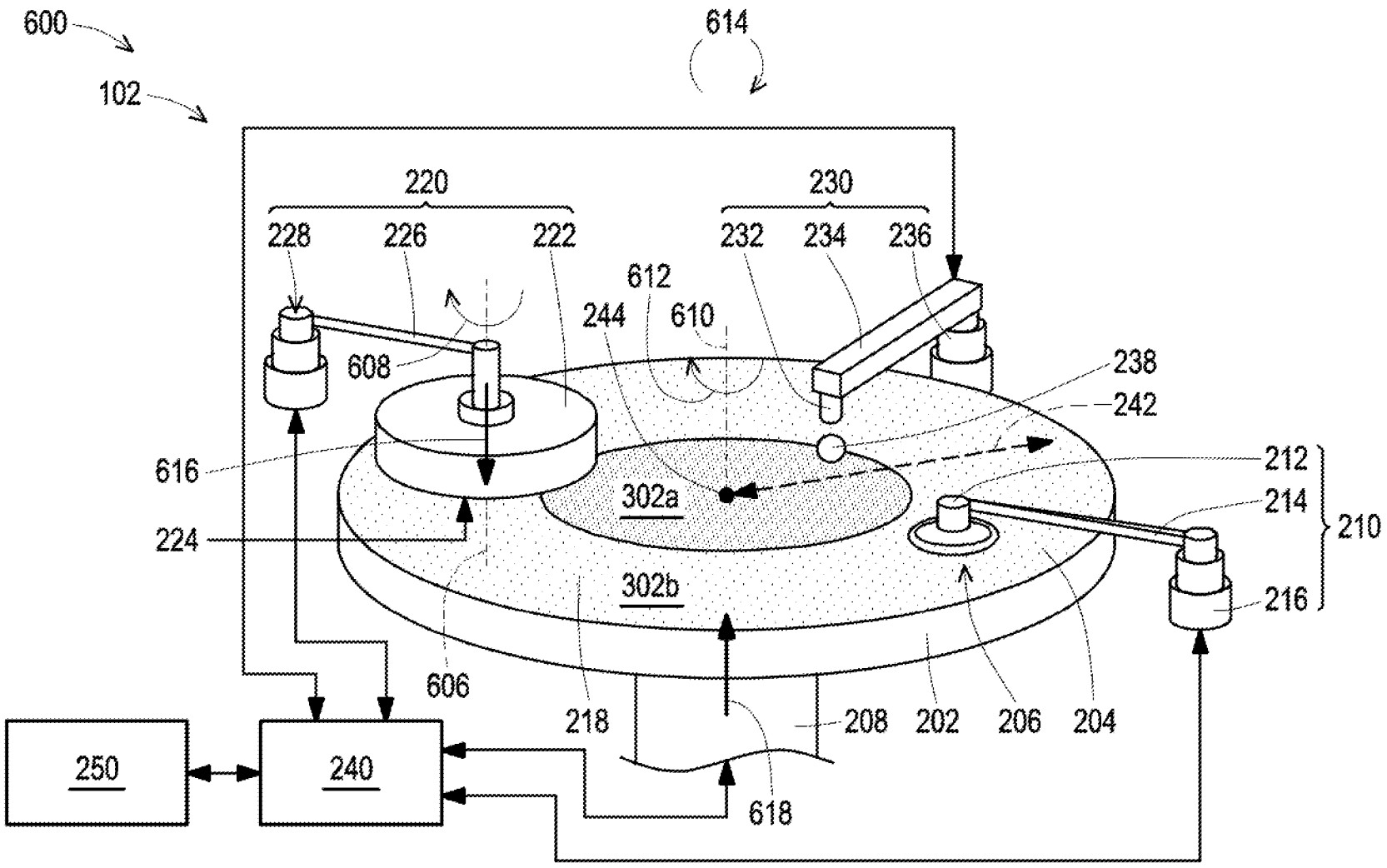

FIGS. 6A-6C are diagrams of an example series of operations 600 using the polishing pad described herein 204. In some implementations, the series of operations 600 is performed within the processing chamber 102 of the CMP tool 100 of FIGS. 1 and 2.

As shown in FIG. 6A and as part of a series of operations 602, the polishing head 222 may receive the semiconductor substrate 224. The polishing head 222 may be above the platen including the polishing pad 204.

In some implementations the polishing pad 204 includes two or more regions including two or more pad surface patterns. For example, as shown in FIG. 6A and as described in connection with FIG. 4A and elsewhere herein, the polishing pad 204 may include the pad surface pattern 302*a* occupying the central region of the polishing pad 204. Additionally, or alternatively, the polishing pad may include the pad surface pattern 302*b* occupying a remaining region of the polishing pad 204.

As shown in FIG. 6B and as part of a series of operations 604, the motor assembly 240 may initiate a rotation of the polishing head 222 (e.g., the semiconductor substrate 224) about a central axis 606 of the polishing head 222. The rotation of the polishing head 222 may correspond to a rotational vector 608 including a rotational velocity in radians per second and a direction that is counter-clockwise, among other examples. In some implementations, the rotation of the polishing head 222 by the motor controller system, including the rotational velocity and/or direction, is in response to a signal received from the CMP controller 250.

Additionally or alternatively and as part of the series of operations 604, the motor assembly 240 may initiate a rotation of the platen 202 (e.g., the polishing pad 204) about a central axis 610 of the platen 202. The rotation of the platen 202 may correspond to a rotational vector 612 including a rotational velocity in radians per second and a direction that is clockwise, among other examples. In some implementations, the rotation of the platen 202 by the motor assembly 240, including the rotational velocity and/or direction, is based on a signal received from the CMP controller 250.

As shown in FIG. 6C and as part of a series of operations 614, the polishing pad 204 and the semiconductor substrate 224 may be engaged to initiate a polishing operation (e.g., the polishing operation 254 of FIG. 2, among other examples). In some implementations, engaging the semiconductor substrate 224 and the polishing pad 204 includes the motor assembly 240 applying a vertical motion 616 (including a vertical force) to the polishing head 222. In some implementations, engaging the semiconductor substrate 224 and the polishing pad 204 includes the motor assembly 240 applying a vertical motion 618 (including a vertical force) to the platen 202. The polishing operation may concurrently polish two or more portions of the semiconductor substrate 224.

As part of the series of operations 614, the polishing operation may concurrently polish two or more portions of the semiconductor substrate 224. Additionally, or alternatively, polishing rates for the two or more of the semiconductor substrate 224 (e.g., a polishing rate for an edge portion of the semiconductor substrate 224 and a polishing rate for a central portion of the semiconductor substrate 224, among other examples) may vary. As shown in FIG. 6C, the polishing rates may be based, at least in part, on qualities of the pad surface patterns 302*a* and 302*b*.

In some implementations, and during the series of operations 614, one or more parameters associated with the polishing operation may be adjusted. For example, the CMP controller 250 may provide a signal to the motor assembly 240 to change a parameter (e.g., a rotational velocity, a rotational acceleration, and/or a rotational direction) related to the rotational vector 608 and/or the rotational vector 612. Additionally, or alternatively, the CMP controller 250 may provide a signal to the motor assembly 240 to change a vertical force related to the vertical motion 616 and/or the vertical motion 618. As described in connection with FIG. 2C, the CMP controller 250 may use a machine learning model to adjust such parameters.

As indicated above, FIGS. 6A-6C are provided as an example. Other examples may differ from what is described with regard to FIGS. 6A-6C.

Figure 7:
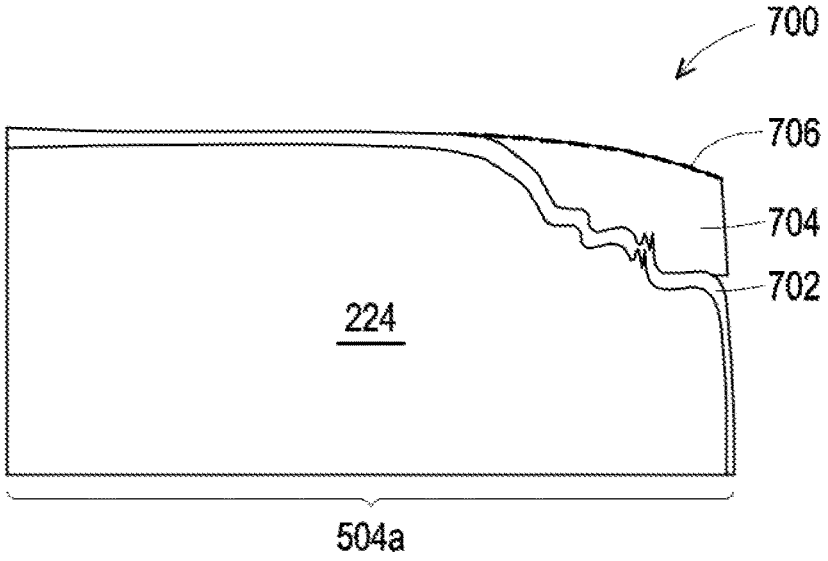
FIG. 7 is a diagram of an example roll-off profile described herein.

FIG. 7 is a diagram of an example roll-off profile 700 described herein. The roll-off profile 700 may be included in the outer portion 504*a* of the semiconductor substrate 224. In some implementations, the polishing pad 204 including selected combinations of the pad surface pattern 302 may control the roll-off profile 700 to satisfy a threshold associated with a multi-wafer stacking or bonding process (e.g., a wafer-on-wafer, or WoW, bonding process among other examples).

As shown in FIG. 7, the semiconductor substrate 224 may include a combination of material layers 702 and 704. The material layer 702 may include a silicon dioxide ($SiO_2$) material, among other examples. The material layer 704 may include a silicon oxynitride (SiON) material, among other examples.

Based on the materials, a polishing pad including a combination of surface patterns (e.g., the polishing pad 204 including a combination of the pad surface pattern(s) 302 as described in connection with FIGS. 3-6C, among other examples), may control a curvature 706 of the roll-off profile 700 to satisfy a threshold. By controlling the curvature 706 to satisfy the threshold (e.g., controlling the curvature 706 to include a roll-off depth of less than approximately 5000 angstroms (Å), among other examples), the roll-off profile 700 may be consistently formed to improve a yield of semiconductor substrates 224 used for the multi-wafer stacking process.

Using machine learning techniques described in connection with FIG. 2C, two or more complementary roll-off profiles 700 (e.g., matching or inverse profiles, among other examples) may be formed for two or more semiconductor substrates 224 included in a multi-wafer stacking process. Additionally, or alternatively and for a multi-wafer stacking process, the roll-off profile 700 of a first semiconductor substrate 224 may be formed to compensate for the roll-off profile 700 of a second semiconductor substrate 224 not satisfying a threshold.

As indicated above, FIG. 7 is provided as an example. Other examples may differ from what is described with regard to FIG. 7.

Figure 8:
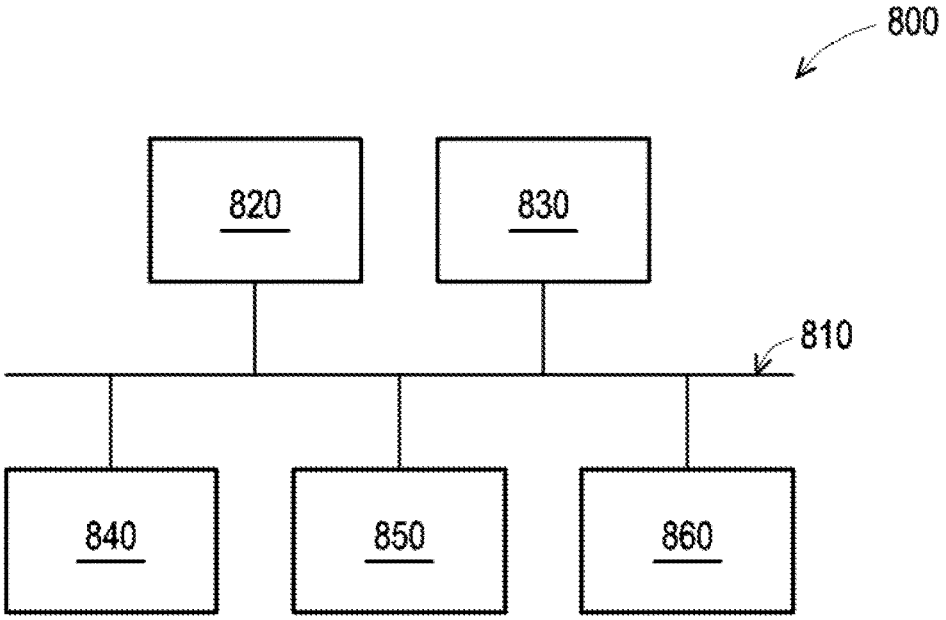
FIG. 8 is a diagram of example components of one or more devices of FIGS. 1 and 2A-2C described herein.

FIG. 8 is a diagram of example components of one or more devices of FIGS. 1 and 2A-2C described herein. The device 800 may correspond to the CMP tool 100 and/or the CMP controller 250. In some implementations, the CMP tool 100 and/or the CMP controller 250 may include one or more devices 800 and/or one or more components of the device 800. As shown in FIG. 8, the device 800 may include a bus 810, a processor 820, a memory 830, an input component 840, an output component 850, and/or a communication component 860.

The bus 810 may include one or more components that enable wired and/or wireless communication among the components of the device 800. The bus 810 may couple together two or more components of FIG. 8, such as via operative coupling, communicative coupling, electronic coupling, and/or electric coupling. For example, the bus 810 may include an electrical connection (e.g., a wire, a trace, and/or a lead) and/or a wireless bus. The processor 820 may include a central processing unit, a graphics processing unit, a microprocessor, a controller, a microcontroller, a digital signal processor, a field-programmable gate array, an application-specific integrated circuit, and/or another type of processing component. The processor 820 may be implemented in hardware, firmware, or a combination of hardware and software. In some implementations, the processor 820 may include one or more processors capable of being programmed to perform one or more operations or processes described elsewhere herein.

The memory 830 may include volatile and/or nonvolatile memory. For example, the memory 830 may include random access memory (RAM), read only memory (ROM), a hard disk drive, and/or another type of memory (e.g., a flash memory, a magnetic memory, and/or an optical memory). The memory 830 may include internal memory (e.g., RAM, ROM, or a hard disk drive) and/or removable memory (e.g., removable via a universal serial bus connection). The memory 830 may be a non-transitory computer-readable medium. The memory 830 may store information, one or more instructions, and/or software (e.g., one or more software applications) related to the operation of the device 800. In some implementations, the memory 830 may include one or more memories that are coupled (e.g., communicatively coupled) to one or more processors (e.g., processor 820), such as via the bus 810. Communicative coupling between a processor 820 and a memory 830 may enable the processor 820 to read and/or process information stored in the memory 830 and/or to store information in the memory 830.

The input component 840 may enable the device 800 to receive input, such as user input and/or sensed input. For example, the input component 840 may include a touch screen, a keyboard, a keypad, a mouse, a button, a microphone, a switch, a sensor, a global positioning system sensor, an accelerometer, a gyroscope, and/or an actuator. The output component 850 may enable the device 800 to provide output, such as via a display, a speaker, and/or a light-emitting diode. The communication component 860 may enable the device 800 to communicate with other devices via a wired connection and/or a wireless connection. For example, the communication component 860 may include a receiver, a transmitter, a transceiver, a modem, a network interface card, and/or an antenna.

The device 800 may perform one or more operations or processes described herein. For example, a non-transitory computer-readable medium (e.g., memory 830) may store a set of instructions (e.g., one or more instructions or code) for execution by the processor 820. The processor 820 may execute the set of instructions to perform one or more operations or processes described herein. In some implementations, execution of the set of instructions, by one or more processors 820, causes the one or more processors 820 and/or the device 800 to perform one or more operations or processes described herein. In some implementations, hard-wired circuitry may be used instead of or in combination with the instructions to perform one or more operations or processes described herein. Additionally, or alternatively, the processor 820 may be configured to perform one or more operations or processes described herein. Thus, implementations described herein are not limited to any specific combination of hardware circuitry and software.

The number and arrangement of components shown in FIG. 8 are provided as an example. The device 800 may include additional components, fewer components, different components, or differently arranged components than those shown in FIG. 8. Additionally, or alternatively, a set of components (e.g., one or more components) of the device 800 may perform one or more functions described as being performed by another set of components of the device 800.

Figure 9:
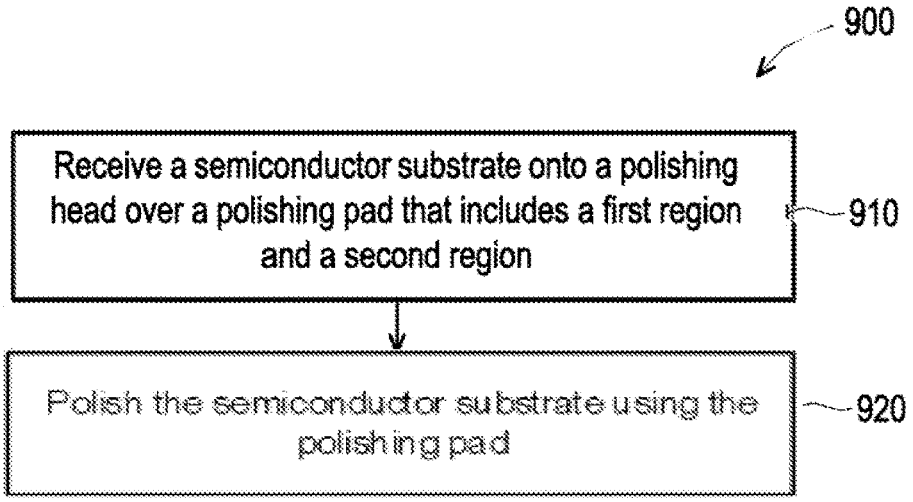
FIGS. 9 and 10 are flowcharts of example process associated with CMP tool including the polishing pad described herein.
Figure 10:
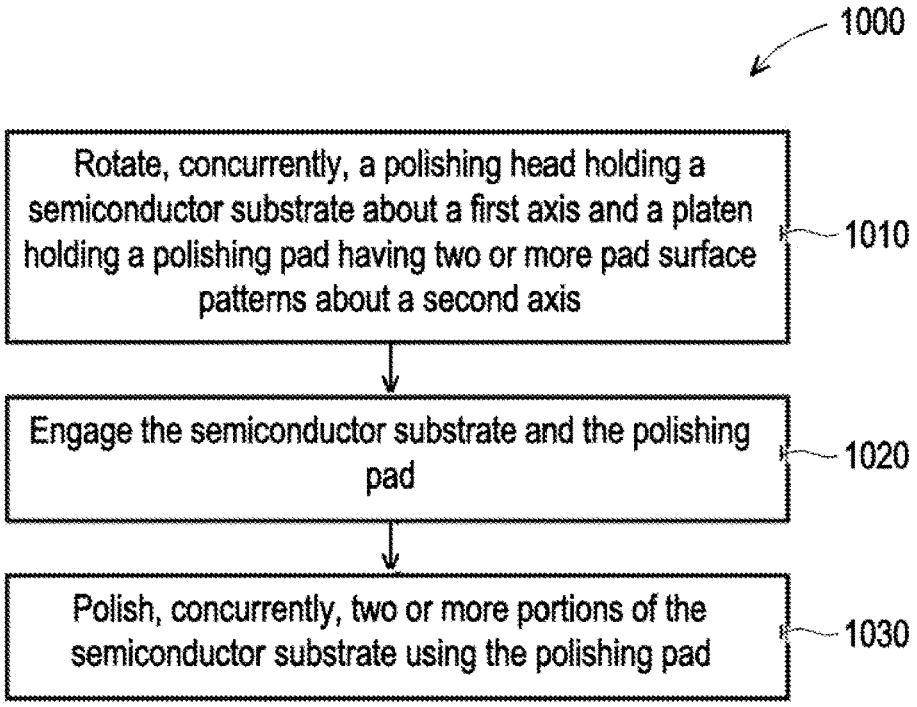

FIG. 9 is a flowchart of an example process 900 associated with the CMP tool 100 including the polishing pad 204 described herein. In some implementations, one or more process blocks of FIG. 9 are performed by the CMP tool 100. In some implementations, one or more process blocks of FIG. 10 are performed by another device or a group of devices separate from or included as part of the CMP tool 100, such as the platen, 202, the polishing pad 204, the polishing head 222, the motor assembly 240, and/or the CMP controller 250. Additionally, or alternatively, one or more process blocks of FIG. 9 may be performed by one or more components of device 800, such as processor 820, memory 830, input component 840, output component 850, and/or communication component 860.

As shown in FIG. 9, process 900 may include receiving a semiconductor substrate onto a polishing head over a polishing pad that includes a first region and a second region (block 910). For example, the CMP tool 100 may receive a semiconductor substrate 224 onto a polishing head 222 over a polishing pad 204 that includes a first region and a second region, as described above. In some implementations, the first region include a first set of properties related to a first pad surface pattern (e.g., the pad surface pattern 302*a*). In some implementations, the first set of properties corresponds to a first polishing rate for a first portion of the semiconductor substrate 224 during a polishing operation using the polishing pad 204. In some implementations, the second region includes a second set of properties related to a second pad surface pattern (e.g., the pad surface pattern 302*b*). In some implementations, the second set of properties corresponds to a second polishing rate for a second portion of the semiconductor substrate 224 during the polishing operation. In some implementations, the second set of properties is different from the first set of properties.

As further shown in FIG. 9, process 900 may include polishing the semiconductor substrate using the polishing pad (block 920). For example, the CMP tool 100 may polish the semiconductor substrate 224 using the polishing pad 204 as described herein.

Process 900 may include additional implementations, such as any single implementation or any combination of implementations described below and/or in connection with one or more other processes described elsewhere herein.

In a first implementation, polishing the semiconductor substrate 224 using the polishing pad 204 includes polishing the first portion of the semiconductor substrate 224 at the first polishing rate using the first region and the second portion of the semiconductor substrate at the second polishing rate using the second region.

In a second implementation, alone or in combination with the first implementation, the first polishing rate and the second polishing rate are a different polishing rate.

In a third implementation, alone or in combination with one or more of the first and second implementations, the first set of properties includes a first pattern density, and where the second set of properties includes a second pattern density that is different from the first pattern density.

In a fourth implementation, alone or in combination with one or more of the first through third implementations, the first set of properties includes a first material, and where the second set of properties includes a second material that is different from the first material.

In a fifth implementation, alone or in combination with one or more of the first through fourth implementations, the first set of properties includes a first quality related to a first groove (e.g., a first case of the groove 304), unit (e.g., a first case of the unit 306), pore (e.g., a first case of the pore 308), or asperity (e.g., a first case of the asperity 310) included in the first pad surface pattern. In some implementations, the second set of properties includes a second quality related to a corresponding second groove (e.g., second case of the groove 304), unit (e.g., a second case of the unit 306), pore (e.g., a second case of the pore 308), or asperity (e.g., a second case of the asperity 310) included in the second pad surface pattern. In some implementations, the second quality is different than the first quality.

Although FIG. 9 shows example blocks of process 900, in some implementations, process 900 includes additional blocks, fewer blocks, different blocks, or differently arranged blocks than those depicted in FIG. 9. Additionally, or alternatively, two or more of the blocks of process 900 may be performed in parallel.

FIG. 10 is a flowchart of an example process 1000 associated with the CMP tool 100 including the polishing pad 204 described herein. In some implementations, one or more process blocks of FIG. 10 are performed by the CMP tool 100. In some implementations, one or more process blocks of FIG. 10 are performed by another device or a group of devices separate from or included as part of the CMP tool 100, such as the platen 202, the polishing pad 204, the polishing head 222, the motor assembly 240, and/or the CMP controller 250. Additionally, or alternatively, one or more process blocks of FIG. 10 may be performed by one or more components of device 800, such as processor 820, memory 830, input component 840, output component 850, and/or communication component 860.

As shown in FIG. 10, process 1000 may include rotating, concurrently, a polishing head holding a semiconductor substrate about a first axis and a platen holding a polishing pad having two or more pad surface patterns about a second axis (block 1010). For example, the CMP tool 100 (e.g., the motor assembly 240) may rotate, concurrently, a polishing head 222 holding a semiconductor substrate 224 about a first axis and a platen 202 holding a polishing pad 204 having two or more pad surface patterns (e.g., the pad surface patterns 302*a* and 302*b*) about a second axis, as described above. In some implementations, the platen 202 holding the polishing pad 204 is below the polishing head 222. In some implementations, rotating the polishing head 222 about the first axis includes rotating the polishing head 222 about a central axis 606 of the polishing head 222 using a first rotational vector (e.g., the rotational vector 608). In some implementations, rotating the platen 202 about the second axis includes rotating the platen 202 about a central axis 610 of the platen 202 using a second rotational vector (e.g., the rotational vector 612).

As further shown in FIG. 10, process 1000 may include engaging the semiconductor substrate and the polishing pad (block 1020). For example, the CMP tool 100 (e.g., the platen 202 and the semiconductor substrate carrier 220) may engage the semiconductor substrate 224 and the polishing pad 204, as described above.

As further shown in FIG. 10, process 1000 may include polishing, concurrently, two or more portions of the semiconductor substrate using a polishing pad (block 1030). For example, the CMP tool 100 may polish, concurrently, two or more portions (e.g., the portions 502*a*-502*c*) of the semiconductor substrate 224 using a polishing pad 204, as described above.

Process 1000 may include additional implementations, such as any single implementation or any combination of implementations described below and/or in connection with one or more other processes described elsewhere herein.

In a first implementation, process 1000 includes determining, by a controller (e.g., the CMP controller 250) using a machine learning model, an adjustment to a setting controlling the first rotational vector (e.g., the rotational vector 608) or the second rotational vector (e.g., the rotational vector 612) based on a property of at least one of the two or more pad surface patterns (e.g., the pad surface patterns 302*a* and 302*b*).

In a second implementation, alone or in combination with the first implementation, process 1000 includes determining, by a controller (e.g., the CMP controller 250) using a machine learning model, an adjustment to a setting controlling a flow rate of a slurry 238 based on a property of at least one of the two or more pad surface patterns (e.g., the pad surface patterns 302*a* and 302*b*).

In a third implementation, alone or in combination with one or more of the first and second implementations, process 1000 includes determining, by a controller (e.g., the CMP controller 250) using a machine learning model, an adjustment to a setting controlling a compressive force (e.g., a vertical force related to the vertical motion 616 and/or the vertical motion 618) that engages the semiconductor substrate 224 to the polishing pad 204 based on a property of at least one of the two or more pad surface patterns (e.g., the pad surface patterns 302*a* and 302*b*).

In a fourth implementation, alone or in combination with one or more of the first through third implementations, concurrently polishing the two or more regions of the semiconductor substrate includes polishing an edge region 504 of the semiconductor substrate 224 to control a roll-off profile 700 of the edge portion.

In a fifth implementation, alone or in combination with one or more of the first through fourth implementations, the semiconductor substrate 224 corresponds to a first semiconductor substrate, the two or more portions correspond to two or more first portions further includes rotating, concurrently, the polishing head 222 holding a second semiconductor substrate about the first axis and the platen 202 holding the polishing pad 204 having two or more pad surface patterns (e.g., the pad surface patterns 302*a* and 302*b*), about the second axis, where the platen 202 holding the polishing pad 204 is below the second semiconductor substrate, where rotating the polishing head 222 about the first axis includes rotating the polishing head 222 about the central axis (e.g., the central axis 606) of the polishing head 222 using a third rotational vector, where rotating the platen 202 about the second axis includes rotating the platen 202 about the central axis (e.g., the central axis 610) of the platen 202 using a fourth rotational vector, where the third rotational vector and/or the fourth rotational vector are based on the roll-off profile 700 of the edge portion (e.g., the outer portion 504*a*) of the first semiconductor substrate 224, and polishing, concurrently, two or more second portions (e.g., the portions 502*a*-502*c*) of the second semiconductor substrate using the polishing pad 204.

Although FIG. 10 shows example blocks of process 1000, in some implementations, process 1000 includes additional blocks, fewer blocks, different blocks, or differently arranged blocks than those depicted in FIG. 10. Additionally, or alternatively, two or more of the blocks of process 1000 may be performed in parallel.

Some implementations herein describe a CMP tool including a polishing pad. The CMP tool including the polishing pad may perform a polishing operation to a semiconductor substrate. The polishing operation may generate, along a perimeter of the semiconductor substrate, a roll-off profile that satisfies a threshold. The polishing pad includes two or more regions, where each region includes a different pad surface pattern. Each region including a different pad surface pattern may correspond to a different polishing rate. Techniques using the polishing pad having such zone and pad surface pattern combinations allow for a focused and a controlled polishing of the semiconductor substrate, including along the perimeter of the semiconductor substrate to tightly control the roll-off profile.

In this way, the roll-off profile of the semiconductor substrate may be consistently formed to improve a yield related to a semiconductor substrate stacking process. Additionally, an amount or resources needed to fabricate a volume of stacked semiconductor substrates (e.g., semiconductor manufacturing tools, materials, power, and/or supporting computing resources, among other examples) may be reduced relative to techniques that include polishing the semiconductor substrate using a CMP tool including a polishing pad with a single pattern.

As described in greater detail above, some implementations described herein provide a method. The method includes receiving a semiconductor substrate onto a polishing head over a polishing pad that includes a first region and a second region, where the first region includes a first set of properties related to a pad surface pattern, where the first set of properties corresponds to a first polishing rate for a first portion of a semiconductor substrate during a polishing operation using the polishing pad, where the second region includes a second set of properties related to the pad surface pattern, where the second set of properties corresponds to a second polishing rate for a second portion of the semiconductor substrate during the polishing operation, and where the second set of properties is different from the first set of properties. The method includes polishing the semiconductor substrate using the polishing pad.

As described in greater detail above, some implementations described herein provide a method. The method includes rotating, concurrently, a polishing head holding a semiconductor substrate about a first axis and a platen holding a polishing pad having two or more pad surface patterns about a second axis, where the platen holding the polishing pad is below the substrate carrier, where rotating the polishing head about the first axis includes rotating the polishing head about a central axis of the polishing head using a first rotational vector, and where rotating the platen about the second axis includes rotating the platen about a central axis of the platen using a second rotational vector. The method includes engaging the semiconductor substrate and the polishing pad. The method includes polishing, concurrently, two or more portions of the semiconductor substrate using a polishing pad.

As described in greater detail above, some implementations described herein provide a system. The system includes a platen. The system includes a polishing pad over the platen. The polishing pad includes a first pad surface pattern occupying a first region of the polishing pad, where the first pad surface pattern corresponds to a first polishing rate for a semiconductor substrate during a polishing operation using the polishing pad. The polishing pad includes a second pad surface pattern occupying a second region of the polishing pad, where the second pad surface pattern is different from the first pad surface pattern, and where the second pad surface pattern corresponds to a second polishing rate for the semiconductor substrate during the polishing operation using the polishing pad.

As used herein, "satisfying a threshold" may, depending on the context, refer to a value being greater than the threshold, greater than or equal to the threshold, less than the threshold, less than or equal to the threshold, equal to the threshold, not equal to the threshold, or the like.

As used herein, the term "and/or," when used in connection with a plurality of items, is intended to cover each of the plurality of items alone and any and all combinations of the plurality of items. For example, "A and/or B" covers "A and B," "A and not B," and "B and not A."

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

receiving a semiconductor substrate onto a polishing head over a polishing pad that comprises a first region and a second region, wherein the first region comprises a first set of properties related to a first pad surface pattern, wherein the first set of properties corresponds to a first polishing rate for a first portion of the semiconductor substrate during a polishing operation using the polishing pad, and wherein the second region comprises a second set of properties related to a second pad surface pattern, wherein the second set of properties corresponds to a second polishing rate for a second portion of the semiconductor substrate during the polishing operation, and wherein the second set of properties is different from the first set of properties, wherein the first pad surface pattern and the second pad surface pattern are associated with a roll-off profile at or near an edge portion of the semiconductor substrate; and polishing the semiconductor substrate using the polishing pad.

2. The method of claim 1, wherein polishing the semiconductor substrate using the polishing pad comprises:

polishing the first portion of the semiconductor substrate at the first polishing rate using the first region and the second portion of the semiconductor substrate at the second polishing rate using the second region.

3. The method of claim 2, wherein:

the first polishing rate and the second polishing rate are different polishing rates, or the first polishing rate and the second polishing rate are a same polishing rate.

4. The method of claim 1, wherein the first set of properties comprises:

a first pattern density, and wherein the second set of properties comprises a second pattern density that is different from the first pattern density.

5. The method of claim 1, wherein the first set of properties comprises a first material, and wherein the second set of properties comprises a second material that is different from the first material.

6. The method of claim 1, wherein the first set of properties comprises a first quality related to a first groove, unit, pore, or asperity included in the first pad surface pattern, and wherein the second set of properties comprises a second quality related to a corresponding second groove, unit, pore, or asperity included in the second pad surface pattern, wherein the second quality is different than the first quality.

7. A method, comprising:

rotating, concurrently, a polishing head holding a semiconductor substrate about a first axis and a platen holding a polishing pad having two or more pad surface patterns about a second axis, wherein the platen holding the polishing pad is below the polishing head, wherein the two or more pad surface patterns are associated with a roll-off profile at or near an edge portion of the semiconductor substrate, wherein rotating the polishing head about the first axis comprises rotating the polishing head about a central axis of the polishing head using a first rotational vector, and wherein rotating the platen about the second axis comprises rotating the platen about a central axis of the platen using a second rotational vector;

engaging the semiconductor substrate and the polishing pad; and polishing, concurrently, two or more portions of the semiconductor substrate using the polishing pad.

8. The method of claim 7, further comprising:

determining, by a controller using machine learning, an adjustment to a setting controlling the first rotational vector or the second rotational vector based on a property of at least one of the two or more pad surface patterns.

9. The method of claim 7, further comprising:

determining, by a controller using machine learning, an adjustment to a setting controlling a flow rate of a slurry based on a property of at least one of the two or more pad surface patterns.

10. The method of claim 7, further comprising:

determining, by a controller using machine learning, an adjustment to a setting controlling a compressive force that engages the semiconductor substrate to the polishing pad based on a property of at least one of the two or more pad surface patterns.

11. The method of claim 7, wherein concurrently polishing the two or more portions of the semiconductor substrate comprises:

polishing the edge portion of the semiconductor substrate to control the roll-off profile.

12. The method of claim 11, wherein the semiconductor substrate corresponds to a first semiconductor substrate, the two or more portions correspond to two or more first portions, and further comprising:

rotating, concurrently, the polishing head holding a second semiconductor substrate about the first axis and the platen holding the polishing pad having the two or more pad surface patterns about the second axis, wherein the platen holding the polishing pad is below the second semiconductor substrate, wherein rotating the polishing head about the first axis comprises rotating the polishing head about the central axis of the polishing head using a third rotational vector, wherein rotating the platen about the second axis comprises rotating the platen about the central axis of the platen using a fourth rotational vector, and wherein the third rotational vector and/or the fourth rotational vector are based on the roll-off profile of the edge portion of the first semiconductor substrate, and polishing, concurrently, two or more second portions of the second semiconductor substrate using the polishing pad.

13. A system, comprising:

a platen; and a polishing pad over the platen and comprising:

a first predefined pad surface pattern occupying a first region of the polishing pad, wherein the first predefined pad surface pattern corresponds to a first polishing rate during a polishing operation using the polishing pad; and a second predefined pad surface pattern occupying a second region of the polishing pad, wherein the second predefined pad surface pattern is different from the first predefined pad surface pattern, and wherein the second predefined pad surface pattern corresponds to a second polishing rate during the polishing operation using the polishing pad; and a semiconductor substrate positioned on the polishing pad, wherein the semiconductor substrate has a roll-off profile.

14. The system of claim 13,
wherein the first region of the polishing pad corresponds to a ring-shaped region between a center of the polishing pad and a perimeter region of the polishing pad.

15. The system of claim 13,
wherein the first region of the polishing pad corresponds to a segment of a ring-shaped region of the polishing pad.

16. The system of claim 13,
wherein the first region of the polishing pad corresponds to a central region of the polishing pad.

17. The system of claim 13,
wherein the first region of the polishing pad corresponds to a perimeter region of the polishing pad.

18. The system of claim 13,
wherein the first polishing rate and the second polishing rate are a same approximate polishing rate.

19. The system of claim 13,
wherein the first polishing rate and the second polishing rate are a different polishing rate.

20. The system of claim 13,
wherein the polishing pad over the platen further comprises:
a third predefined pad surface pattern,
wherein the third predefined pad surface pattern is different from the first predefined pad surface pattern and the second predefined pad surface pattern, and
wherein the third predefined pad surface pattern corresponds to a third polishing rate.

* * * * *